US007677690B2

(12) United States Patent
Takatsuka

(10) Patent No.: US 7,677,690 B2
(45) Date of Patent: Mar. 16, 2010

(54) LIQUID EJECTION APPARATUS AND LIQUID AGITATION METHOD

(75) Inventor: Tsutomu Takatsuka, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 404 days.

(21) Appl. No.: 11/602,353

(22) Filed: Nov. 21, 2006

(65) Prior Publication Data

US 2007/0115329 A1 May 24, 2007

(30) Foreign Application Priority Data

Nov. 22, 2005 (JP) ..... 2005-337583
Nov. 22, 2005 (JP) ..... 2005-337584
Nov. 22, 2005 (JP) ..... 2005-337585

(51) Int. Cl.
*B41J 2/165* (2006.01)

(52) U.S. Cl. ..... 347/27; 347/29

(58) Field of Classification Search ..... 347/27
See application file for complete search history.

(56) References Cited

U.S. PATENT DOCUMENTS 5,298,923 A * 3/1994 Tokunaga et al. ..... 347/23
5,574,485 A * 11/1996 Anderson et al. ..... 347/28
5,650,802 A 7/1997 Suzuki et al.
5,784,081 A * 7/1998 Ozaki et al. ..... 347/30
6,334,662 B2 * 1/2002 Hollands ..... 347/35
6,908,174 B2 * 6/2005 Suzuki ..... 347/35
7,165,832 B2 * 1/2007 Kojima ..... 347/31
2001/0012029 A1 * 8/2001 Momose ..... 347/30
2004/0263560 A1 * 12/2004 Nakashima ..... 347/32
2007/0080990 A1 * 4/2007 Karppinen et al. ..... 347/31

FOREIGN PATENT DOCUMENTS

JP 03227657 A * 10/1991
JP 6-87220 A 3/1994
JP 2001287377 A * 10/2001
JP 2002-96484 A 4/2002
JP 2003-72104 A 3/2003
JP 2005-138488 A 6/2005

OTHER PUBLICATIONS

English Translation of Japanese Patent Document JP 03227657 A to Takada et al., translation performed by Schreiber Translations, Inc. in Oct. 2009.*

* cited by examiner

*Primary Examiner*—Matthew Luu
*Assistant Examiner*—Shelby Fidler
(74) *Attorney, Agent, or Firm*—Birch, Stewart, Kolasch & Birch, LLP.

(57) ABSTRACT

A liquid ejection apparatus which ejects liquid toward a prescribed medium is provided. The apparatus includes a liquid ejection head which has an ejection port ejecting liquid, and an energy application element applying energy to the liquid to be ejected from the ejection port; and a liquid receiving device which is opposite to the ejection port and receives the liquid ejected from the ejection port. The liquid received by the liquid receiving device forms a liquid pool between the liquid receiving device and the ejection port and the liquid is agitated by a driving device which applies a drive signal to the energy application element.

9 Claims, 20 Drawing Sheets

LIQUID EJECTION APPARATUS AND LIQUID AGITATION METHOD

BACKGROUND OF THE INVENTION

1. Field of the Invention

The present invention relates to a liquid ejection apparatus and a liquid agitation method, and more particularly, to a liquid ejection apparatus which ejects liquid toward a prescribed medium and a liquid agitation method for agitating the liquid.

2. Description of the Related Art

There is a liquid ejection apparatus which ejects dispersion liquid in which dispersed micro-particles are suspended. Examples of material of the micro-particles include, for instance, pigment, high-polymer resin, metal, glass, or oxide or compound of these. Generally, the micro-particles tend to aggregate and settle with the passage of time. When the liquid in which the micro-particles have aggregated and settled is ejected, then there is deterioration of quality in the ejection results, namely, density non-uniformities or distortions, poor color reproduction, non-uniform density of the micro-particles, and the like. Therefore, technology for agitating the dispersion liquid has been proposed.

Japanese Patent Application Publication No. 6-87220 discloses that piezoelectric elements are used as energy converting elements for ejecting ink, and are also driven to agitate the ink under a condition where ejection of the ink does not occur, thereby re-dispersing solids in the ink that have aggregated and settled.

Japanese Patent Application Publication No. 2002-96484 discloses that the piezoelectric elements are driven in a state where the nozzle openings are sealed with a sealing cap, thereby agitating pigment-based ink inside pressure chambers and a reservoir.

Japanese Patent Application Publication No. 2003-72104 discloses that a manifold for guiding ink to nozzles is provided with a first agitation device (piezoelectric element) to agitate the ink inside the manifold, a supply channel for supplying the ink to the manifold is provided with a second agitation device to agitate the ink inside the supply channel, and a container storing the ink is provided with a third agitation device to agitate the ink inside the container.

Japanese Patent Application Publication No. 2005-138488 discloses that an agitation mechanism for agitating ink inside an ink tank is provided, and a control unit for operating the agitation mechanism before supplying the ink from the ink tank is also provided.

In particular, in a liquid ejection apparatus having a liquid ejection head in which the liquid ejection face is situated in a bottommost position, nozzle blockages are liable to occur due to sedimented micro-particles in the nozzles. In the case of a so-called shuttle head structure in which the liquid ejection head performs a reciprocal back and forth movement, the liquid inside the liquid ejection head is agitated by the reciprocal motion of the liquid ejection head, but in the case of a line head structure where the liquid ejection head does not perform reciprocal movement, the liquid is not agitated usually.

Methods for agitating the liquid have been proposed, but it is difficult to agitate the liquid with good efficiency.

In Japanese Patent Application Publication Nos. 6-87220 and 2002-96484, the voltage of the input signal (drive signal) applied to the piezoelectric elements must be set within a range that does not cause liquid ejection, it is then impossible to vibrate the liquid with a relatively large amplitude, and hence a sufficient agitation effect cannot be obtained. More specifically, under the drive conditions in the range that does not cause the liquid ejection, the agitation performance inside the pressure chamber is poor and improvement in the state of micro-particles that have aggregated and sedimented in the vicinity of the nozzle openings cannot be expected.

Moreover, the liquid is present not only inside the liquid ejection head, but also in the tank storing the liquid supplied to the liquid ejection head, and in the liquid supply channel leading from the tank to the liquid ejection head. Since sedimentation and aggregation of the micro-particles occur at a plurality of locations, then, in order to achieve a uniform density of the liquid inside the whole apparatus, liquid agitation devices must be arranged at the plurality of locations.

For example, in Japanese Patent Application Publication No. 2003-72104, the liquid agitation devices are required in the manifold, the supply channels and the container; hence, not only does this raise costs, but it also leads to increase in the size of the apparatus.

In Japanese Patent Application Publication No. 2005-138488, in a case where a main tank and a sub-tank are provided as ink tanks, since the liquid is always present in both of the tanks, then it is necessary to provide the liquid agitation devices in both the main tank and the sub-tank.

However, in practice, it is difficult to provide liquid agitation devices in all of the locations in which the liquid is present separately within the apparatus.

Furthermore, in general, when the apparatus is left in a power-off state, the liquid ejection operation and the liquid supply operation are halted and no liquid agitation operation is carried out for a long period of time. In order to achieve a uniform liquid density within the whole apparatus when the power is turned on, it is necessary to agitate the liquid at different locations while circulating the liquid within the apparatus for a long duration, or the like, and accordingly it is necessary to lengthen the agitation operation duration. Hence, there is a problem in that the preparation duration before carrying out liquid ejection becomes long.

SUMMARY OF THE INVENTION

The present invention has been contrived in view of the foregoing circumstances, an object thereof being to provide a liquid ejection apparatus and a liquid agitation method whereby the liquid to be ejected can be agitated efficiently and satisfactorily.

More specifically, firstly, the object is to provide a liquid ejection apparatus and a liquid agitation method, whereby deterioration of liquid quality due to aggregation and sedimentation of the micro-particles in the liquid in the vicinity of the ejection port can be prevented, and liquid can be ejected stably. Secondly, the object is to provide a liquid ejection apparatus and a liquid agitation method whereby the liquid inside the apparatus can be set to a uniform density and can be agitated efficiently. Thirdly, the object is to provide a liquid ejection apparatus and a liquid agitation method whereby the liquid inside the liquid ejection head can be agitated satisfactorily.

In order to attain the aforementioned object, the present invention is directed to the liquid ejection apparatus, comprising: a liquid ejection head which has an ejection port ejecting liquid, and an energy application element applying energy to the liquid to be ejected from the ejection port; a liquid receiving device which is opposite to the ejection port and receives the liquid ejected from the ejection port, the liquid received by the liquid receiving device forming a liquid pool between the liquid receiving device and the ejection port; and a driving device which applies a drive signal to the energy application element in a state where the liquid pool has been formed, so as to agitate the liquid at least in a vicinity of the ejection port.

According to this aspect of the present invention, compared with the related art in which the liquid is agitated with forming no liquid pool, it is possible to apply a drive signal that produces a greater displacement of the liquid to the energy application element, and furthermore, it is possible to satisfactorily agitate the liquid in the vicinity the ejection port, by making the liquid in the vicinity of the ejection port exit and enter the ejection port and thus causing this liquid to vibrate. Moreover, semi-solid material of increased viscosity, solid material, dust, and the like, having adhered to the ejection face can be removed.

Preferably, the driving device causes a frequency of the drive signal to continuously change from a first frequency to a second frequency different from the first frequency.

According to this aspect of the present invention, it is possible to use a single standard waveform for the drive signal used for the liquid agitation, in the case of various states of the micro-particles (for example, cases where the liquid to be ejected differs between apparatuses, cases where a plurality of different types of liquid are to be ejected from one apparatus, cases where micro-particles of a plurality of different types are contained in the liquid, cases where liquid is ejected in an environment of changing temperature, and the like). Therefore, the circuit composition is simplified and manufacturing costs are reduced.

Preferably, the liquid receiving device includes a belt which has an opening section and a liquid receiving face, the belt being switchable by rotation between a state where the opening section is opposite to the ejection port and a state where the liquid receiving face is opposite to the ejection port.

According to this aspect of the present invention, it is possible to make the liquid ejected from the ejection port of the liquid ejection head pass through the opening section of the belt. In other words, it is possible to use the liquid receiving device as both a liquid receptacle for dummy ejection and a liquid receptacle for the liquid agitation.

Preferably, the liquid receiving device includes a wiper which slides on an ejection face of the liquid ejection head.

According to this aspect of the present invention, it is possible to use the liquid receiving device as both a liquid receptacle for wiping the ejection face and a liquid receptacle for the liquid agitation.

Preferably, the liquid receiving device includes a sealing member which hermetically seals an ejection face of the liquid ejection head.

According to this aspect of the present invention, it is possible to use the liquid receiving device as both a cap for hermetically sealing the ejection port and a liquid receptacle for the liquid agitation.

Preferably, the liquid ejection apparatus further comprises: a suction device which is connected to the liquid receiving device, wherein the suction device suctions the liquid from the ejection port of the liquid ejection head in a state where the liquid receiving device is in hermetic contact with the liquid ejection head.

According to this aspect of the present invention, it is possible to use the liquid receiving device as both a liquid receptacle for suctioning and a liquid receptacle for the liquid agitation.

Preferably, the liquid receiving device has a liquid-philic surface having liquid-philic properties and a liquid-phobic surface having liquid-phobic properties; and the liquid pool is formed between the liquid-philic surface serving as a liquid receiving face and the ejection port of the liquid ejection head.

According to this aspect of the present invention, it is possible to form a stable liquid pool by setting the liquid-philic surface to a position opposite to the ejection face of the liquid ejection head.

For example, a coloring material is dispersed in the liquid; and the liquid ejected from the ejection port is deposited on a prescribed recording medium to form an image on the recording medium, whereby the liquid ejection apparatus serves as an image forming apparatus.

In order to attain the aforementioned object, the present invention is also directed to a liquid agitation method of agitating liquid in a liquid ejection head which has an ejection port ejecting the liquid, and an energy application element applying energy to the liquid to be ejected from the ejection port, the method comprising the steps of: setting a liquid receiving device to a position opposite to the ejection port of the liquid ejection head, the liquid receiving device receiving the liquid ejected from the ejection port; forming a liquid pool between the ejection port and the liquid receiving device in a state where the ejection port and the liquid receiving device are opposite to each other; and applying a drive signal to the energy application element in a state where the liquid pool has been formed, so as to agitate the liquid at least in a vicinity of the ejection port.

In order to attain the aforementioned object, the present invention is also directed to a liquid ejection apparatus, comprising: a liquid ejection head which ejects liquid; a liquid storage device which stores the liquid to be supplied to the liquid ejection head; a liquid returning device which returns substantially all of the liquid inside the liquid ejection head to the liquid storage device; and a liquid agitation device which agitates the liquid inside the liquid storage device in a state where substantially all of the liquid inside the liquid ejection head has been returned to the liquid storage device by the liquid returning device.

According to this aspect of the present invention, since the liquid inside the liquid ejection apparatus is agitated by returning the liquid into one place, then no differential occurs in the state of agitation inside the liquid ejection apparatus, and the density of the liquid inside the liquid ejection apparatus is maintained substantially uniform. Furthermore, since the liquid in the liquid ejection apparatus is agitated after being returned into one place, then it is possible to efficiently agitate the liquid inside the liquid ejection apparatus.

Preferably, the liquid ejection apparatus further comprises a driving device which drives the liquid agitation device to agitate the liquid inside the liquid storage device through a standby power source when a main power source used for liquid ejection by the liquid ejection head is in an off state.

According to this aspect of the present invention, when the main power source is in the off state, in other words, when the liquid ejection apparatus is in an idle state, the liquid is still agitated inside the liquid storage device, and the liquid inside the liquid ejection apparatus is maintained at a uniform density. Furthermore, when the main power source is turned on, in other words, when the liquid ejection apparatus is started up, it is rapidly possible that the liquid is supplied to the liquid ejection head and the first liquid ejection operation is carried out.

Preferably, the liquid ejection apparatus further comprises a driving device which drives the liquid agitation device to agitate the liquid inside the liquid storage device when a main power source used for liquid ejection by the liquid ejection head is turned on.

According to this aspect of the present invention, since the liquid is agitated together inside the liquid storage device when the main power source is turned on, the quality of the initially ejected liquid is stabilized.

Preferably, the liquid agitation device includes a stirrer which rotates inside the liquid storage device; and the liquid ejection apparatus further comprises a driving device which drives the stirrer to rotate while changing with time at least one of a rotational direction of the stirrer and a rotational speed of the stirrer.

According to this aspect of the present invention, it is possible to efficiently make the density of the liquid uniform in a short period of time.

For example, a coloring material is dispersed in the liquid; and the liquid ejected from the ejection port is deposited on a prescribed recording medium to form an image on the recording medium, whereby the liquid ejection apparatus serves as an image forming apparatus.

In order to attain the aforementioned object, the present invention is also directed to a liquid agitation method of agitating liquid in a liquid ejection apparatus which has a liquid ejection head ejecting the liquid, and a liquid storage device storing the liquid to be supplied to the liquid ejection head, the method comprising the steps of: returning substantially all of the liquid inside the liquid ejection head to the liquid storage device; and agitating the liquid inside the liquid storage device in a state where substantially all of the liquid inside the liquid ejection head has been returned to the liquid storage device.

In order to attain the aforementioned object, the present invention is also directed to a liquid ejection apparatus, comprising: an ejection port which ejects liquid; a pressure chamber which is connected to the ejection port; an energy application element which applies energy to the liquid to be ejected from the ejection port; a liquid surface movement device which moves a free surface of the liquid positioned in a vicinity of the ejection port toward the pressure chamber; and a driving device which applies a drive signal to the energy application element in a state where the free surface of the liquid has been moved toward the pressure chamber by the liquid surface movement device, so as to agitate at least the liquid inside the pressure chamber.

According to this aspect of the present invention, compared with the related art in which the liquid is agitated in a state where the free surface of the liquid is positioned in the vicinity of the ejection port, it is possible to apply a drive signal that produces a greater displacement of the liquid, to the energy application element, without causing ejection of the liquid, and therefore it is possible to satisfactorily agitate the liquid.

Preferably, the driving device causes a frequency of the drive signal to continuously change from a first frequency to a second frequency different from the first frequency.

According to this aspect of the present invention, it is possible to use a single standard waveform for the drive signal used for the liquid agitation, in the case of various states of the micro-particles (for example, cases where the liquid to be ejected differs between apparatuses, cases where a plurality of different types of liquid are to be ejected from one apparatus, cases where micro-particles of a plurality of different types are contained in the liquid, cases where liquid is ejected in an environment of changing temperature, and the like). Therefore, the circuit composition is simplified and manufacturing costs are reduced.

Preferably, the driving device applies an ejection drive signal to the energy application element so as to eject the liquid from the ejection port; and wave forms of the ejection drive signal and the drive signal applied to agitate the liquid are identical with each other.

According to this aspect of the present invention, it is possible to use a single standard waveform for the drive signals, both in the case of the liquid ejection and the case of the liquid agitation, and therefore the circuit composition is simplified and manufacturing costs are reduced.

Preferably, the liquid surface movement device moves the free surface of the liquid having been positioned in the vicinity of the ejection port to one of a position within an ejection flow channel between the ejection port and the pressure chamber, and a boundary between the ejection flow channel and the pressure chamber.

For example, a coloring material is dispersed in the liquid; and the liquid ejected from the ejection port is deposited on a prescribed recording medium to form an image on the recording medium, whereby the liquid ejection apparatus serves as an image forming apparatus.

In order to attain the aforementioned object, the present invention is also directed to a liquid agitation method of agitating liquid in a liquid ejection head which has an ejection port ejecting the liquid, a pressure chamber connected to the ejection port, and an energy application element applying energy to the liquid to be ejected from the ejection port, the method comprising the steps of: moving a free surface of the liquid positioned in a vicinity of the ejection port toward the pressure chamber; and applying a drive signal to the energy application element in a state where the free surface of the liquid has been moved toward the pressure chamber, so as to agitate at least the liquid inside the pressure chamber.

According to the present invention, it is possible to agitate the liquid for ejection efficiently and satisfactorily. Moreover, the liquid in the apparatus can be maintained at a uniform density. Furthermore, it is possible to satisfactorily agitate the liquid by achieving a large displacement of the liquid when agitating the liquid inside the liquid ejection head. Therefore deterioration of the liquid due to aggregation and/or sedimentation of micro-particles in the liquid is prevented, and the liquid can be ejected stably.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Liquid Ejection Head

Figure 1:
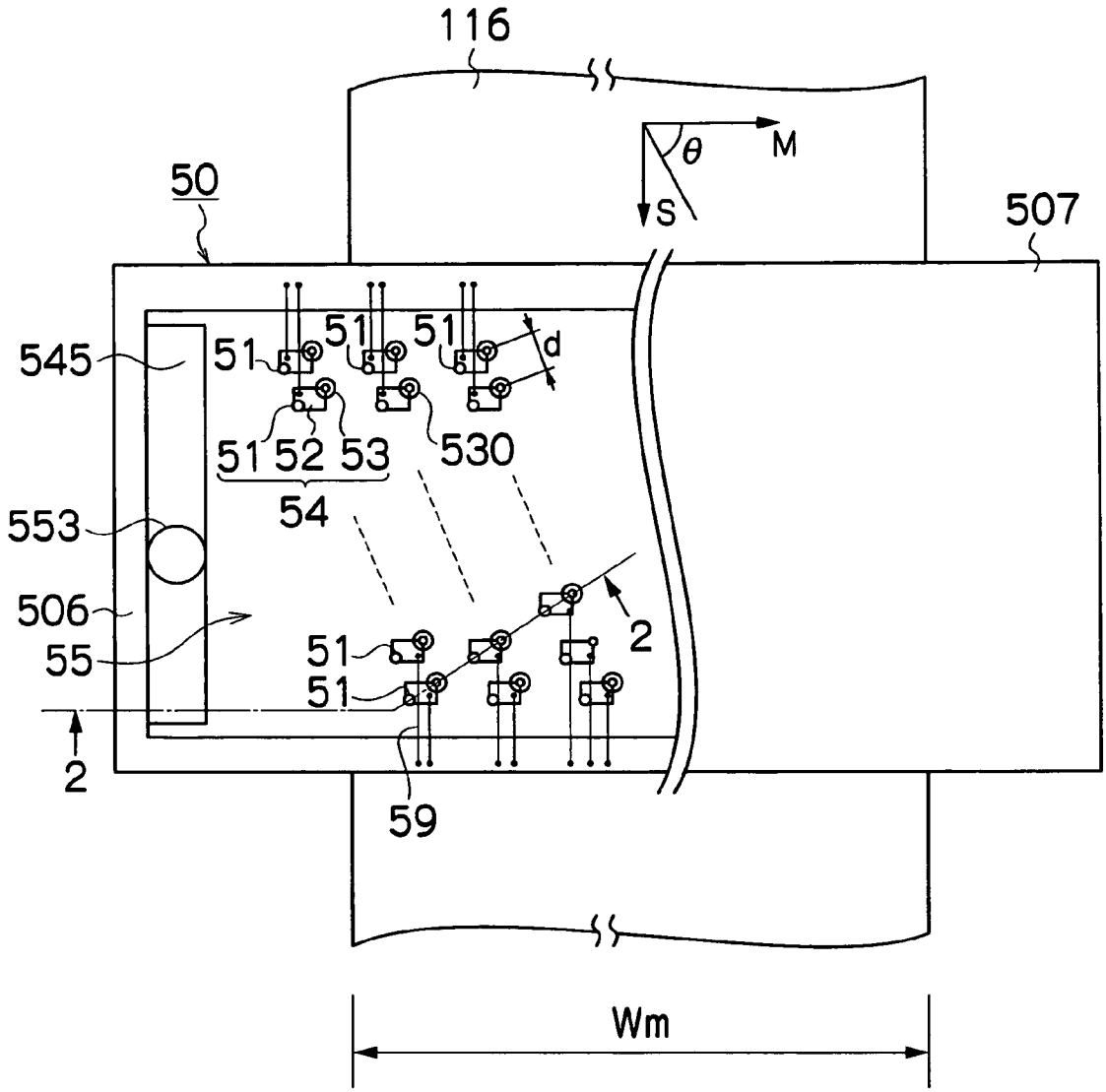
FIG. 1 is a plan view perspective diagram showing an approximate view of the general structure of a liquid ejection head according to an embodiment of the present invention.

FIG. 1 is a plan diagram showing the general structure of a liquid ejection head in a liquid ejection device according to an embodiment of the present invention, giving a perspective view of the left-hand half in the diagram.

The liquid ejection head 50 shown in FIG. 1 is a so-called full line head, having a structure in which a plurality of liquid ejection ports or nozzles 51, which eject liquid toward an ejection receiving medium or a recording medium 116, are arranged through a length corresponding to a width Wm of the recording medium 116 in a main scanning direction indicated by arrow M in FIG. 1 perpendicular to a sub-scanning direction indicated by arrow S in FIG. 1, which is a conveyance direction of the recording medium 116.

More specifically, the liquid ejection head 50 has a composition in which a plurality of pressure chamber units 54, each having the nozzle 51, a pressure chamber 52 connected to the nozzle 51, and an opening section serving as a liquid supply port 53 to supply the liquid to the pressure chamber 52, are arranged two-dimensionally along two directions, namely, the main scanning direction, and an oblique direction forming a prescribed acute angle θ (where $0° < \theta < 90°$) with respect to the main scanning direction. In FIG. 1, in order to simplify the drawing, some of the pressure chamber units 54 are omitted from the drawing.

More specifically, by arranging the nozzles 51 at a uniform pitch of d in the direction forming the acute angle of θ with respect to the main scanning direction, it is possible to treat the nozzles 51 as being equivalent to an arrangement of nozzles at a prescribed pitch ($d \times \cos\theta$) in a straight line in the main scanning direction. According to this nozzle arrangement, for example, it is possible to achieve a composition substantially equivalent to a high-density nozzle arrangement reaching 4800 nozzles per inch in the main scanning direction. In other words, the effective nozzle pitch (projected nozzle pitch) obtained by projecting the nozzles to a straight line aligned with the lengthwise direction of the liquid ejection head 50 (the main scanning direction) can be reduced, and high image resolution can be achieved.

A common liquid chamber 55 supplying the liquid or ink to the pressure chambers 52 is formed in a common liquid chamber forming plate 506 as a flow channel that occupies a single space covering all of the pressure chambers 52. An opening formed at an end of the common liquid chamber 55 serves as a liquid inlet port 553, through which the ink is introduced into the common liquid chamber 55 from the outside of the liquid ejection head 50 (more specifically, from a sub-tank 61 described later with reference to FIGS. 5 and 6).

In the present embodiment, the common liquid chamber 55 is formed by etching a metal plate (more specifically, the common liquid chamber forming plate 506), and the rigidity of the common liquid chamber 55 is ensured.

Figure 2:
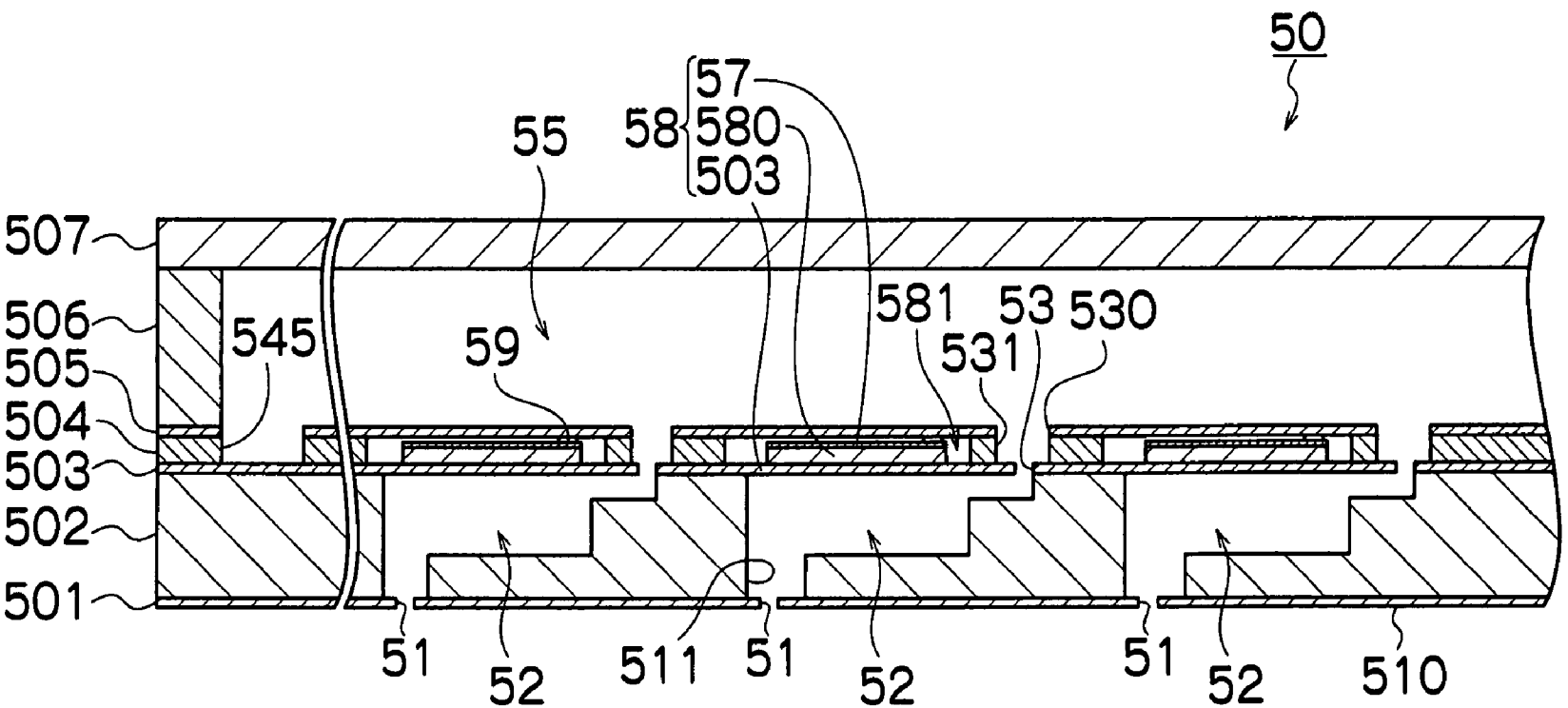
FIG. 2 is a cross-sectional diagram along line 2-2 in FIG. 1.

FIG. 2 shows a cross-sectional view along line 2-2 in FIG. 1. As shown in FIG. 2, the liquid ejection head 50 has a laminated structure of a plurality of plates including a nozzle forming plate 501, a pressure chamber forming plate 502, a diaphragm 503, actuator protection plates 504 and 505, the common liquid chamber forming plate 506, and a sealing plate 507.

The nozzles 51 ejecting the liquid are formed in a two-dimensional matrix fashion in the nozzle forming plate 501.

The pressure chambers 52 connected to the nozzles 51 are formed in the pressure chamber forming plate 502 bonded on the nozzle forming plate 501.

The diaphragm 503, on which actuators 58 are arranged, is bonded on the pressure chamber forming plate 502, and constitutes one face (a vibrating face) of each pressure chamber 52.

Each actuator 58 has a laminated structure of the diaphragm 503, a piezoelectric body 580 for generating pressure, and an individual electrode 57, such that the piezoelectric body 580 is arranged between the diaphragm 503 and the individual electrode 57. The piezoelectric body 580 is made of piezoelectric material such as PZT (lead zirconate titanate), and the diaphragm 503 and the individual electrode 57 are made of conductive material.

The actuators 58 are arranged on the diaphragm 503 at positions corresponding to the pressure chambers 52, and each actuator 58 functions as a pressure generating device causing the pressure inside the pressure chamber 52 to change by changing the volume of the pressure chamber 52.

The diaphragm 503 is grounded, and constitutes a common electrode for the actuators 58. The other electrodes for the actuators 58 are the individual electrodes 57, from which electrical wires (drive wires) 59 for driving the actuators 58 extend.

The liquid supply ports 53 shown in FIG. 1 are formed in the diaphragm 503.

The actuator protection plates 504 and 505 are bonded on the diaphragm 503, and protect the whole actuators 58 while preventing any obstruction of the operation of the actuators 58 by forming spaces 581 around the actuators 58.

The common liquid chamber forming plate 506 is bonded on the actuator protection plate 505 on the side reverse to the side where the actuator protection plate 504, the diaphragm 503, and the pressure chamber forming plate 502 are arranged. The common liquid chamber 55 supplying the liquid to the pressure chambers 52 is formed in the common liquid chamber forming plate 506.

The sealing plate 507 constituting a ceiling of the common liquid chamber 55 is arranged on the common liquid chamber forming plate 506. The space between the actuator protection plate 505 and the sealing plate 507 constitutes the common liquid chamber 55, in which the liquid or ink is filled.

When viewed with the nozzles 51 positioned below the pressure chambers 52, the common liquid chamber 55 is arranged over the pressure chambers 52 and is connected to the pressure chambers 52 through liquid supply flow channels 531 extending from connecting ports 530, which are opening sections formed in the base of the common liquid chamber 55, passing through the actuator protection plates 504 and 505, to the liquid supply ports 53 formed in the diaphragm 503. In other words, the ink inside the common liquid chamber 55 flows directly to the pressure chambers 52 situated under the common liquid chamber 55 through the liquid supply flow channels 531, and good refilling characteristics are hence achieved in the supply of ink to the pressure chambers 52.

The drive wires 59 for the actuators 58 are arranged on the actuator protection plates 504 and 505 in the horizontal direction parallel to the plane on which the actuators 58 are arranged.

There are no particular restrictions on arrangement of the drive wires 59 for the actuators 58. For example, it is possible to arrange the drive wires 59 to pass through the common liquid chamber forming plate 506 in the vertical direction inside partitions defining the liquid chamber 55.

When a drive signal is applied to the individual electrode 57 of the actuator 58 through the drive wire, the piezoelectric body 580 of the actuator 58 is displaced, and the volume of the pressure chamber 52 is changed through the diaphragm 503. Accordingly, the liquid in the pressure chamber 52 is ejected from the nozzle 51 connected to the pressure chamber 52.

The actuator protection plates 504 and 505 are formed with a recess section 545 (recess section for heat transmission), from the common liquid chamber 55 side, passing through the actuator protection plates 505 and 504 in the thickness direction thereof, to the diaphragm 503, in such a manner that the liquid in the common liquid chamber 55 makes direct contact with the diaphragm 503. By adopting the structure in which the recess section 545 is provided in this way, the heat generated by the actuators 58 is transmitted through the diaphragm 503 to the liquid inside the common liquid chamber 55, at the position of the recess section 545. Thus, a temperature differential is generated in the liquid inside the common liquid chamber 55, and the liquid inside the common liquid chamber 55 is thereby made to circulate in the common liquid chamber 55. In other words, the liquid inside the common liquid chamber 55 is agitated by the thermal energy produced by the driving of the actuators 58, and no heat-generating element is necessary other than the actuators 58 in the common liquid chamber 55.

Furthermore, since the common liquid chamber 55 is disposed above the diaphragm 503, then the length of nozzle flow channels 511 from the pressure chambers 52 to the nozzles 51 is short, and it becomes possible to eject ink of high viscosity (for example, approximately 10 cP to 50 cP).

In the present embodiment, the common liquid chamber 55 is formed in the common liquid chamber forming plate 506 as the flow channel that occupies the single space covering all of the pressure chambers 52. It is thereby possible to increase the size of the common liquid chamber 55 and to reduce the flow channel resistance inside the common liquid chamber 55, and hence the present embodiment is suitable for the ejection of high-viscosity liquid. In implementing the present invention, the structure of the common liquid chamber 55 is not limited in particular to the above-described embodiment. For example, it is also possible to form the common liquid chamber 55 in the common liquid chamber forming plate 506 to include a main channel and distributary channels branching from the main channel.

In implementing the present invention, the arrangement structure of the nozzles 51, and the like, is not limited in particular to the embodiment shown in FIGS. 1 and 2. For example, it is also possible to compose a full line liquid ejection head by adopting a staggered arrangement of a plurality of short liquid ejection head blocks each comprising a plurality of nozzles 51 arranged two-dimensionally, thus achieving a long head by joining these liquid ejection head blocks together.

General Composition of Image Forming Apparatus

Figure 3:
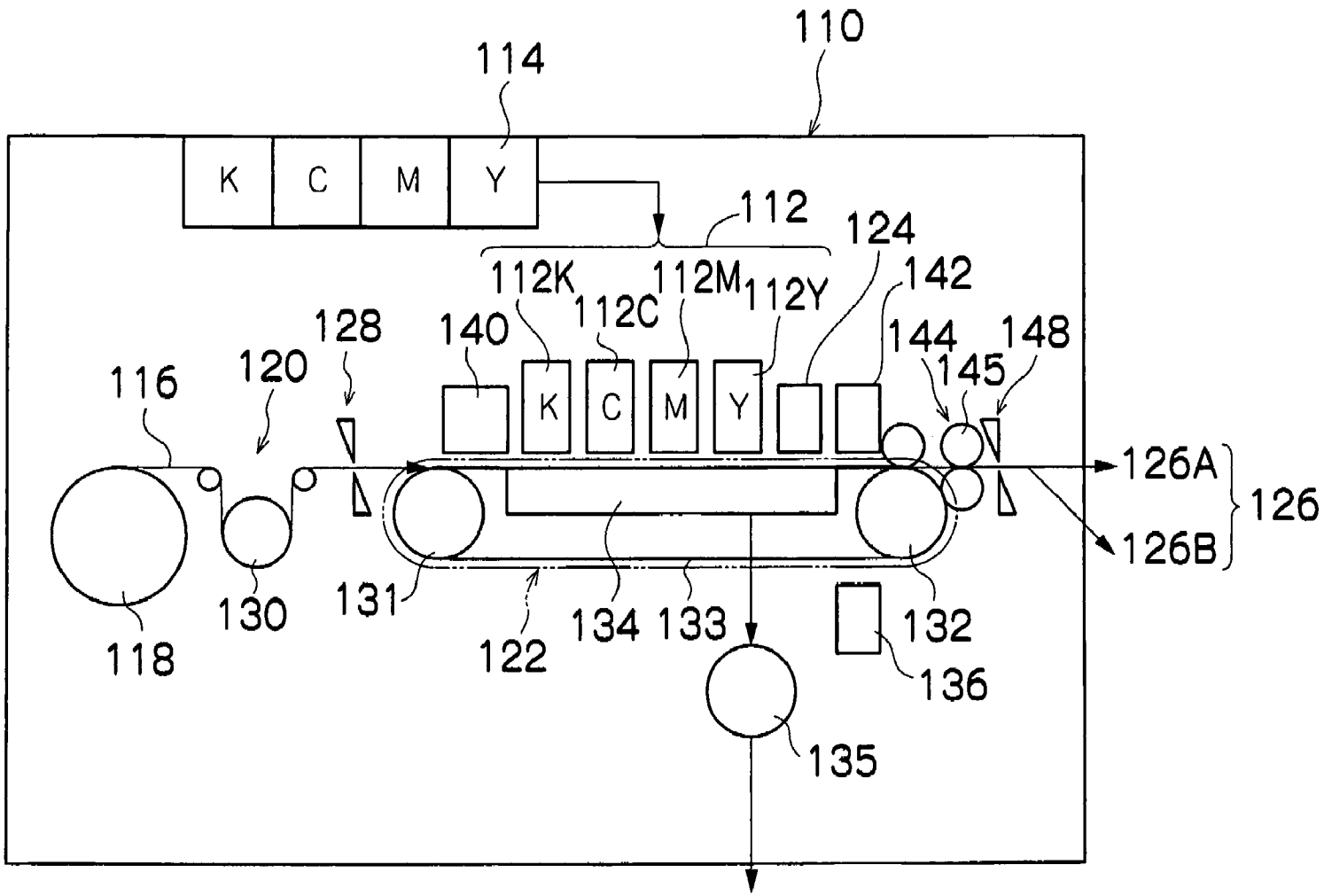
FIG. 3 is a diagram showing the general functional composition of an image forming apparatus according to an embodiment of the present invention.

FIG. 3 is a schematic drawing showing a general view of an image forming apparatus 110 according to an embodiment of the present invention. The image forming apparatus 110 comprises a plurality of the liquid ejection heads 50 shown in FIGS. 1 and 2, and these heads are denoted in FIG. 3 with reference numerals "112" appended with letters indicating the colors of ink ejected (K: black, C: cyan, M: magenta, and Y: yellow).

More specifically, the image forming apparatus 110 comprises: a liquid ejection unit 112 having the liquid ejection heads 112K, 112C, 112M and 112Y for respective ink colors; an ink storing and loading unit 114, which stores the inks to be supplied to the liquid ejection heads 112K, 112C, 112M and 112Y; a paper supply unit 118, which supplies a recording medium 116, such as paper; a decurling unit 120, which removes curl in the recording medium 116; a belt conveyance unit 122, which is disposed facing the nozzle face of the liquid ejection unit 112 and conveys the recording medium 116 while keeping the recording medium 116 flat; a print determination unit 124, which reads the ejection result (liquid droplet deposition state) produced by the liquid ejection unit 112; and a paper output unit 126, which outputs printed recording medium to the exterior.

By depositing liquids (inks) containing coloring agents (also referred to as coloring material) on the recording medium 116 from the liquid ejection heads 112K, 112C, 112M and 112Y, an image is formed on the recording medium 116.

The ink contains an insoluble or slightly water-soluble coloring material dispersed in water, and examples of the coloring material include, for instance, a dispersive dye, a metal complex dye, a pigment, or the like. Examples of dispersing agents for the coloring material in the ink dispersion, it is possible to use a so-called dispersant, surfactant, a resin, or the like. Examples of the dispersant or surfactant include anionic or nonionic materials, and examples of the resin dispersant include styrene or derivatives, vinylnaphthalene or derivatives, acrylic acid or derivatives, and the like. Desirably, the resin dispersant is alkali-soluble resin, which can be dissolved in an aqueous solution containing a basic material. The pigment may be an organic pigment or an inorganic pigment, but it is not limited to these. Pigment-based inks have excellent resistance to light and water; however, they tend to sediment more readily than dye-based inks.

In FIG. 3, a supply of rolled paper (continuous paper) is displayed as one embodiment of the paper supply unit 118, but it is also possible to use a supply unit which supplies cut paper that has been cut previously into sheets. In a case where rolled paper is used, a cutter 128 is provided. The recording medium 116 delivered from the paper supply unit 118 generally retains curl. In order to remove this curl, heat is applied to the recording medium 116 in the decurling unit 120 by a heating drum 130 in the direction opposite to the direction of the curl. After decurling in the decurling unit 24, the cut recording medium 116 is delivered to the belt conveyance unit 122.

The belt conveyance unit 122 has a configuration in which an endless belt 133 is set around rollers 131 and 132 so that the portion of the endless belt 33 facing at least the nozzle face of the liquid ejection unit 112 and the sensor face of the ejection determination unit 124 forms a horizontal plane. The belt 133 has a width that is greater than the width of the recording medium 116, and a plurality of suction apertures are formed on the belt surface. A suction chamber 134 is disposed in a position facing the sensor surface of the ejection determination unit 124 and the nozzle surface of the liquid ejection unit 112 on the interior side of the belt 133, which is set around the rollers 131 and 132, as shown in FIG. 3; and this suction chamber 134 provides suction with a fan 135 to generate a negative pressure, thereby holding the recording medium 116 onto the belt 133 by suction. The belt 133 is driven in the clockwise direction in FIG. 3 by the motive force of a motor (not shown) being transmitted to at least one of the rollers 131 and 132, which the belt 133 is set around, and the recording medium 116 held on the belt 133 is conveyed from left to right in FIG. 3. Since ink adheres to the belt 133 when a marginless print or the like is formed, a belt cleaning unit 136 is disposed in a predetermined position on the exterior side of the belt 133. A heating fan 140 is provided on the upstream side of the liquid ejection unit 112 in the paper conveyance path formed by the belt conveyance unit 122. This heating fan 140 blows heated air onto the recording medium 116 before printing, and thereby heats up the recording medium 116. Heating the recording medium 116 immediately before printing has the effect of making the ink dry more readily after landing on the paper.

Figure 4:
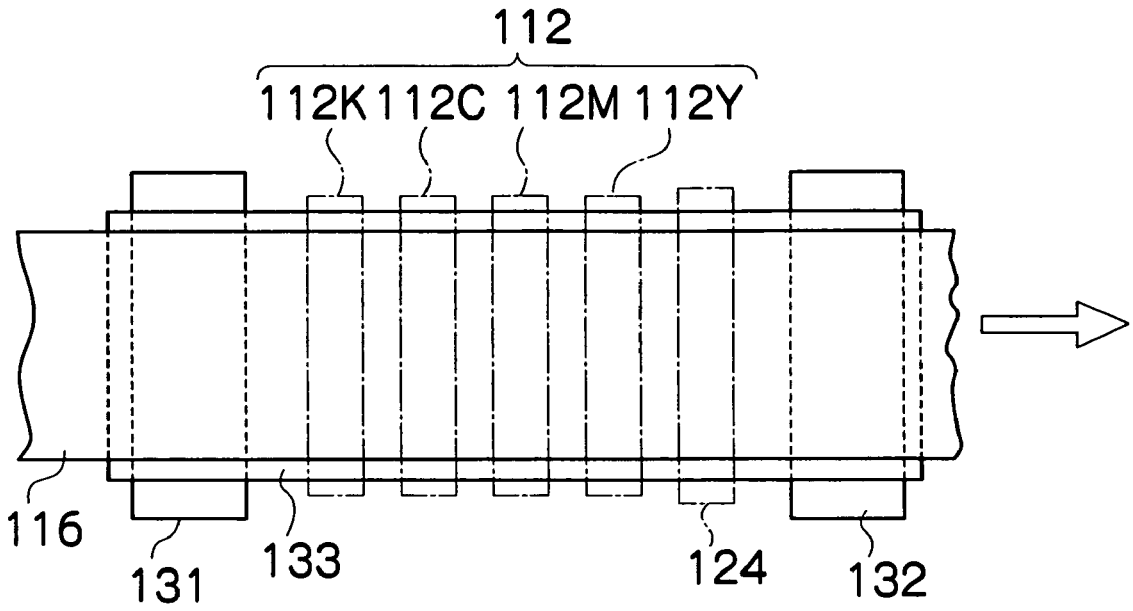
FIG. 4 is a plan diagram showing the principal part of an image forming system of the image forming apparatus.

FIG. 4 is a principal plan diagram showing the liquid ejection unit 112 of the image forming apparatus 110, and the peripheral region of the liquid ejection unit 112.

In FIG. 4, the liquid ejection heads 112K, 112C, 112M and 112Y constituting the liquid ejection unit 112 are arranged following a direction perpendicular to the medium conveyance direction (sub-scanning direction) (in other words, they are arranged in the main scanning direction), and they are full line heads having the nozzles (ejection ports) arranged through a length exceeding at least one edge of the maximum-size recording medium 116 that can be used in the image forming apparatus 110.

The liquid ejection heads 112K, 112C, 112M and 112Y corresponding to the respective ink colors are disposed in the order, black (K), cyan (C), magenta (M) and yellow (Y), from the upstream side (left-hand side in FIG. 4), following the direction of conveyance of the recording medium 116 (the sub-scanning direction). A color image can be formed on the recording medium 116 by ejecting the inks including coloring material from the print heads 112K, 112C, 112M and 112Y, respectively, toward the recording medium 116 while conveying the recording medium 116.

The liquid ejection unit 112, in which the full-line heads are thus provided for the respective ink colors, can record an image over the entire surface of the recording medium 116 by moving the recording medium 116 and the liquid ejection unit 112 relatively to each other in the medium conveyance direction (sub-scanning direction) just once (in other words, by means of a single sub-scanning action). Higher-speed printing is thereby made possible and productivity can be improved in comparison with a shuttle type head which moves reciprocally back and forth in the main scanning direction.

The terms "main scanning direction" and "sub-scanning direction" are used in the following senses. In a full-line head comprising rows of nozzles that have a length corresponding to the entire width of the recording medium, "main scanning" is defined as printing one line (a line formed of a row of dots, or a line formed of a plurality of rows of dots) in the breadthways direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the nozzle from one side toward the other in each of the blocks. The direction indicated by one line recorded by a main scanning action (the lengthwise direction of the band-shaped region thus recorded) is called the "main scanning direction".

On the other hand, sub-scanning is defined as printing the line (a line constituted by a single dot array or a line constituted by a plurality of dot arrays) formed by the main-scanning described above repeatedly by moving the full line head and recording medium relative to each other as described above. The direction in which this sub-scanning is performed is known as the sub-scanning direction. Consequently, the recording medium conveyance direction is the sub-scanning direction, and the direction perpendicular to the sub-scanning direction is the main scanning direction.

Although a configuration with the four standard colors, K, C, M and Y is described in the present embodiment, the combinations of the ink colors and the number of colors are not limited to those of the present embodiment, and light and/or dark inks can be added as required. For example, a configuration is possible in which liquid ejection heads for ejecting light-colored inks such as light cyan and light magenta are added.

As shown in FIG. 3, the ink storing and loading unit 114 has ink tanks for storing the inks of the colors corresponding to the liquid ejection heads 112K, 112C, 112M and 112Y, and the ink tanks are connected to the liquid ejection heads 112K, 112C, 112M and 112Y through channels (not shown).

The ejection determination unit 124 has an image sensor (line sensor, or the like) for capturing an image of the ejection result of the liquid ejection unit 112, and functions as a device to check for ejection defects such as blockages of the nozzles in the liquid ejection unit 12 on the basis of the image read in by the image sensor.

A post-drying unit 142 is provided at a downstream stage from the ejection determination unit 124. The post-drying unit 142 is a device for drying the printed image surface, and it may comprise a heating fan, for example. A heating and pressurizing unit 144 is provided at a stage following the post-drying unit 142. The heating and pressurizing unit 144 is a device which serves to control the luster of the image surface, and it applies pressure and heat to the image surface by means of pressure rollers 145 having prescribed surface undulations. Accordingly, an undulating form is transferred to the image surface.

The printed object generated in this manner is output via the paper output unit 126. In the image forming apparatus 110, a sorting device (not shown) is provided for switching the outputting pathway in order to sort the printed matter with the target print and the printed matter with the test print, and to send them to output units 126A and 126B, respectively. If the main image and the test print are formed simultaneously in a parallel fashion, on a large piece of printing paper, then the portion corresponding to the test print is cut off by means of the cutter (second cutter) 140. The cutter 140 is disposed immediately in front of the paper output section 126, and serves to cut and separate the main image from the test print portion, in cases where a test image is printed onto the white margin of the image. Moreover, although omitted from the drawing, a sorter for collating and stacking the images according to job orders is provided in the paper output section 126A corresponding to the main images.

Liquid Flow System

Figure 5:
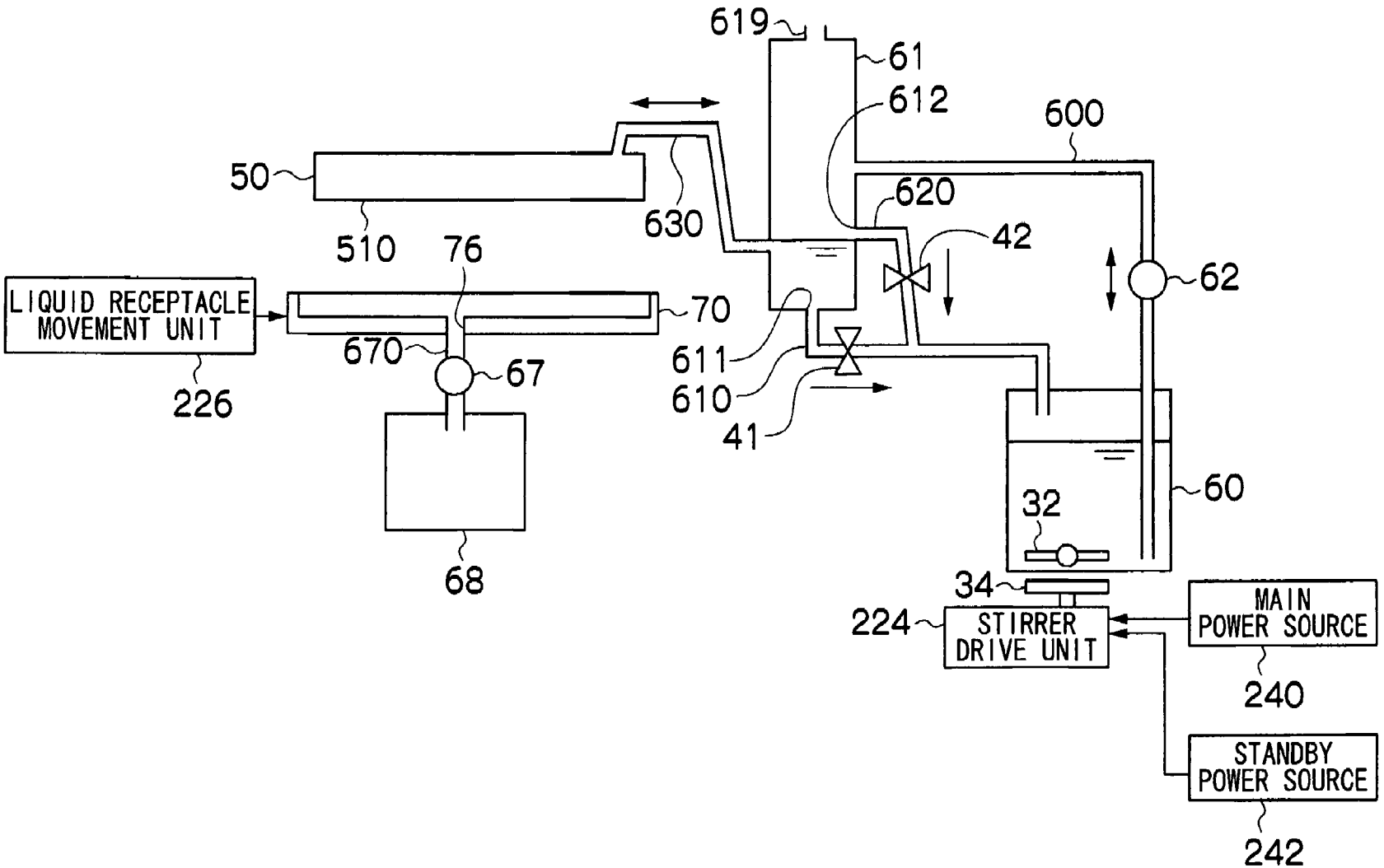
FIG. 5 is a schematic drawing showing the principal part of a liquid flow system of an image forming apparatus according to an embodiment of the present invention.

FIG. 5 is a schematic drawing showing a liquid flow system in the image forming apparatus 110 according to an embodiment of the present invention. In FIG. 5, the liquid ejection head is denoted with the reference numeral 50.

In FIG. 5, the main tank 60 stores liquid to be supplied to the liquid ejection head 50, and it corresponds to the ink storing and loading unit 114 in FIG. 3.

A stirrer 32, in which a metal or magnet member is embedded, is arranged in the main tank 60. A stirrer drive unit 224 having a magnetic member 34 made of magnet or metal (according to the embedded member of the stirrer 34) is arranged on the outer side of the main tank 60, and the stirrer drive unit 224 rotates the stirrer 32 in the main tank 60 by means of a magnetic force without making contact with the stirrer 32, thus causing the stirrer 32 to agitate the liquid inside the main tank 60.

The stirrer 32 in the present embodiment is disposed on the bottom of the main tank 60, and the stirrer 32 agitates the liquid inside the main tank 60 by performing a rotational movement in a plane parallel to the bottom face of the main tank 60 (in other words, a plane parallel to the free surface of the liquid in the main tank 60), taking as the center of rotation an axis following a substantially perpendicular direction with respect to the bottom face of the main tank 60.

It is also possible that the stirrer 32 is arranged at a position other than the bottom of the main tank 60, for example, on the side wall of the main tank 60, and it is further possible that the stirrer 32 performs a rotational movement within a plane other than a horizontal plane, for example, a vertical plane (in other words, a plane perpendicular to the free surface of the liquid in the main tank 60).

When the image forming apparatus 110 is in a power-on state, in other words, when there is a supply of power from a main power source 240 to the respective units of the image forming apparatus 110, the stirrer drive unit 24 rotates the stirrer 32 at prescribed time intervals through an electrical power supplied from the main power source 240, according to the present embodiment. On the other hand, when the image forming apparatus 110 is in a power-off state, the stirrer drive unit 24 rotates the stirrer 32 at prescribed time intervals through an electrical power supplied from a standby power source 242.

The standby power source 242 is constituted by a rechargeable battery or a non-rechargeable battery, or the like.

In the composition in which the stirrer 32 can be driven by means of the standby power source 242 in this way, even if the power to the image forming apparatus 110 is switched off and the image forming apparatus 110 remains in an idle state for a long period of time, the liquid inside the main tank 60 is still agitated during the idle period, and the micro-particles in the liquid are thereby prevented from aggregating and sedimenting.

Although the compositional embodiment is described above in which the stirrer drive unit 224 is not directly coupled to the stirrer 32, it is also possible to adopt a composition in which the stirrer drive unit 224 is directly coupled to the stirrer (for example, a rotating blade).

A sub-tank 61 is provided between the main tank 60 and the liquid ejection head 50, and the liquid supplied from the main tank 60 is stored temporarily in the sub-tank 61 before being supplied to the liquid ejection head 50.

A pump 62 (referred to as a "liquid supply pump") that drives the liquid from the main tank 60 to the sub-tank 61 is provided in a flow channel 600 (referred to as a "first liquid supply flow channel") connecting the main tank 60 and the sub-tank 61. A flow channel 630 (referred to as a "second liquid supply flow channel") connects the sub-tank 61 and the liquid ejection head 50.

An opening section 619 (referred to as an "atmosphere connection port") connecting to the atmosphere is formed in the ceiling of the sub-tank 61. By allowing the air to move into and out of the sub-tank 61 through the atmosphere connection port 619, the pressure inside the sub-tank 61 is kept to the atmospheric pressure.

The internal pressure of the liquid ejection head 50 is adjusted to a prescribed negative pressure by means of the height differential (head differential) between the free surface of the liquid in the sub-tank 61, to which the liquid is supplied with the liquid supply pump 62, and the nozzle face 510 of the liquid ejection head 50. Here, the prescribed negative pressure is a pressure below the atmospheric pressure, and is the pressure that causes the free surface of the liquid (the liquid-atmosphere interface, which is also commonly called "meniscus") in the nozzles 51 to be in the vicinity of the nozzle face 5 10, in preparation for ejection of the liquid.

A first electromagnetic valve 41 is provided in a flow channel 610 (referred to as a "first liquid returning flow channel") connecting the main tank 60 with an opening section 611 formed in the bottom face of the sub-tank 61, and the first electromagnetic valve 41 opens and closes the flow channel 610. A second electromagnetic valve 42 is provided in a flow channel 620 (referred to as a "second liquid returning flow channel") connecting the main tank 60 with an opening section 612 formed in a side wall of the sub-tank 61, and the second electromagnetic valve 42 opens and closes the flow channel 620.

When forming an image, in a state where the first electromagnetic valve 41 is closed and the second electromagnetic valve 42 is opened, the liquid is supplied to the sub-tank 61 from the main tank 60 by driving the liquid supply pump 62 forwards, from a prescribed time period before the start of ejection from the liquid ejection head 50. The liquid is thereby supplied from the sub-tank 61 to the liquid ejection head 50 through the second liquid supply flow channel 630, and the surplus liquid in the sub-tank 61 is returned to the main tank 60 through the opening section 612 in the side wall of the sub-tank 61 and the second liquid returning flow channel 620. Hence, the supply of liquid from the main tank 60 to the sub-tank 61 is stabilized, and the free surface of the liquid in the sub-tank 61 is kept at a uniform height. The pressure inside the liquid ejection head 50 is maintained to the prescribed negative pressure and the free surface of the liquid in the nozzles 51 is positioned, by means of the height differential between the nozzle face 5 10 of the liquid ejection head 50 and the free surface of the liquid in the sub-tank 61, which free surface is maintained as described above. When a prescribed time period has elapsed after the end of the ejection operation, the driving of the liquid supply pump 62 is halted.

On the other hand, when the first electromagnetic valve 41 and the second electromagnetic valve 42 are both opened, the liquid inside the liquid ejection head 50, the liquid inside the second liquid supply flow channel 630 connecting the sub-tank 61 with the liquid ejection head 50, the liquid inside the sub-tank 61, and the liquid inside the first liquid returning flow channel 610 and the second liquid returning flow channel 620 connecting the sub-tank 61 with the main tank 60, is all returned into the main tank 60. Moreover, by driving the liquid supply pump 62 in reverse, the liquid inside the first liquid supply flow channel 600 connecting the main tank 60 with the sub-tank 61 is also returned into the main tank 60.

Further, in the present embodiment, the position of the free surface of the liquid in the nozzles 51 of the liquid ejection head 50 can be withdrawn into the pressure chambers 52 from the vicinity of the nozzle face 510. More specifically, the first electromagnetic valve 41, which serves as a liquid surface movement device, is set to an open state for a prescribed period of time so that the liquid of a prescribed volume corresponding to the displacement of the free surface of the liquid in the nozzles 51 is returned from the liquid ejection head 50 to the sub-tank 61 through the second liquid supply flow channel 630, and the position of the free surface is thereby withdrawn.

A liquid receptacle 70 having a recessed shape receives the liquid ejected from the nozzles 51 of the liquid ejection head 50, in a state where the liquid receptacle 70 is opposite to the nozzle face 510 of the liquid ejection head 50. Moreover, a pump 67 (referred to as a "suction pump") is provided in a flow channel 670 (referred to as an "expulsion flow channel") connecting a waste liquid tank 68 with an opening section 76 (referred to as a "suction port") formed in the bottom face of the liquid receptacle 70. The liquid received in the liquid receptacle 70 from the nozzles 51 of the liquid ejection head 50 is expelled to the waste liquid tank 68 through the expulsion flow channel 670.

A liquid receptacle movement unit 226 is capable of moving the liquid receptacle 70 in a horizontal direction in parallel with the nozzle face 510 of the liquid ejection head 50, and also in a perpendicular direction with respect to the nozzle face 510. The liquid receptacle movement unit 226 includes a commonly known mechanism and a motor.

The liquid receptacle 70 is used for various types of maintenance processes for maintaining the state of the liquid inside the liquid ejection head 50, at the position opposite to the nozzle face 510 of the liquid ejection head 50. Typical examples of maintenance processes using the liquid receptacle 70 are described later in detail.

Figure 6:
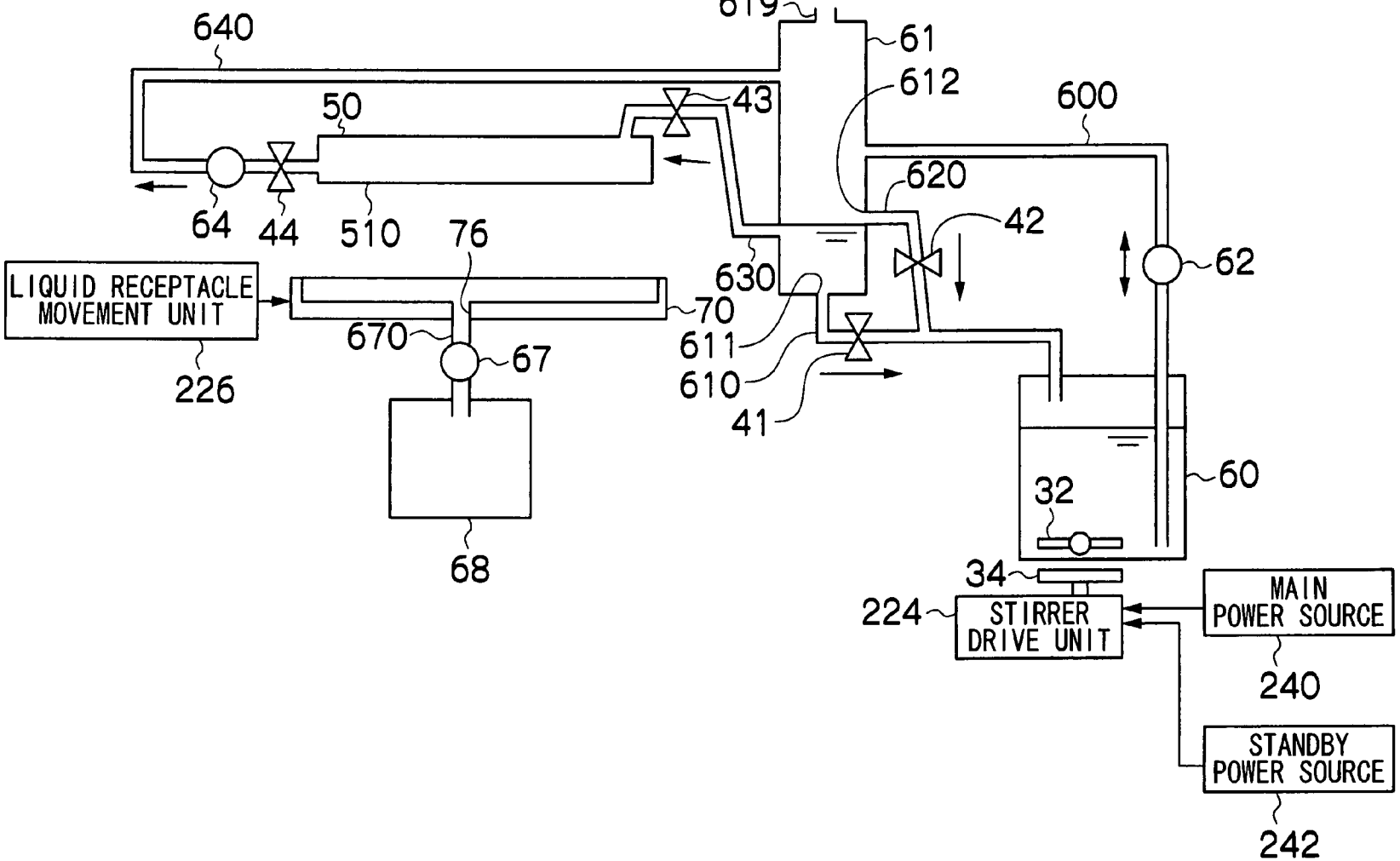
FIG. 6 is a schematic drawing showing the principal part of a liquid flow system of an image forming apparatus according to another embodiment of the present invention.

FIG. 6 is a schematic drawing showing a liquid flow system in the image forming apparatus 110 according to another embodiment of the present invention. In FIG. 6, the constituent elements that are the same as the constituent elements of the liquid-flow system shown in FIG. 5 are denoted with the same reference numerals, and contents described above are omitted from the following description.

In the present embodiment, a third electromagnetic valve 43, which opens and closes the second liquid supply flow channel 630, is provided in the second liquid supply flow channel 630 supplying the liquid from the sub-tank 61 to the liquid ejection head 50, in other words, on the upstream side of the liquid ejection head 50. Moreover, a flow channel 640 (referred to as a "circulation flow channel") for circulating the liquid from the liquid ejection head 50 to the sub-tank 61 is provided. Further, a fourth electromagnetic valve 44 for opening and closing the circulation flow channel 640, and a pump 64 (referred to as a "liquid circulation pump") for circulating the liquid from the liquid ejection head 50 to the sub-tank 61, are provided in the circulation flow channel 640, in other words, on the downstream side of the liquid ejection head 50.

In the liquid flow system shown in FIG. 6, the liquid supplied from the sub-tank 61 to the liquid ejection head 50 is circulated from the liquid ejection head 50 to the sub-tank 61 by driving of the liquid circulation pump 64, and the liquid inside the common liquid chamber 55 is thereby agitated.

In the present embodiment, the position of the free surface of the liquid in the nozzles 51 of the liquid ejection head 50 can be withdrawn into the pressure chambers 52 from the vicinity of the nozzle face 510. More specifically, in a state where the third electromagnetic valve 43 is closed, the fourth electromagnetic valve 44 is set to an open state and the liquid circulation pump 64, which serves as the liquid surface movement device, is driven for a prescribed period of time so that the liquid of a prescribed volume corresponding to the displacement of the free surface of the liquid in the nozzles 51 is returned from the liquid ejection head 50 to the sub-tank 61 through the circulation flow channel 640, and the position of the free surface is thereby withdrawn.

Furthermore, by driving the liquid circulation pump 64 for a prescribed period of time, for instance, when the image forming apparatus 110 is started up (when the power is turned on), it is possible to circulate the liquid through the circulation flow channel 640.

Next, the liquid receptacle 70 is described in detail.

Figure 7:
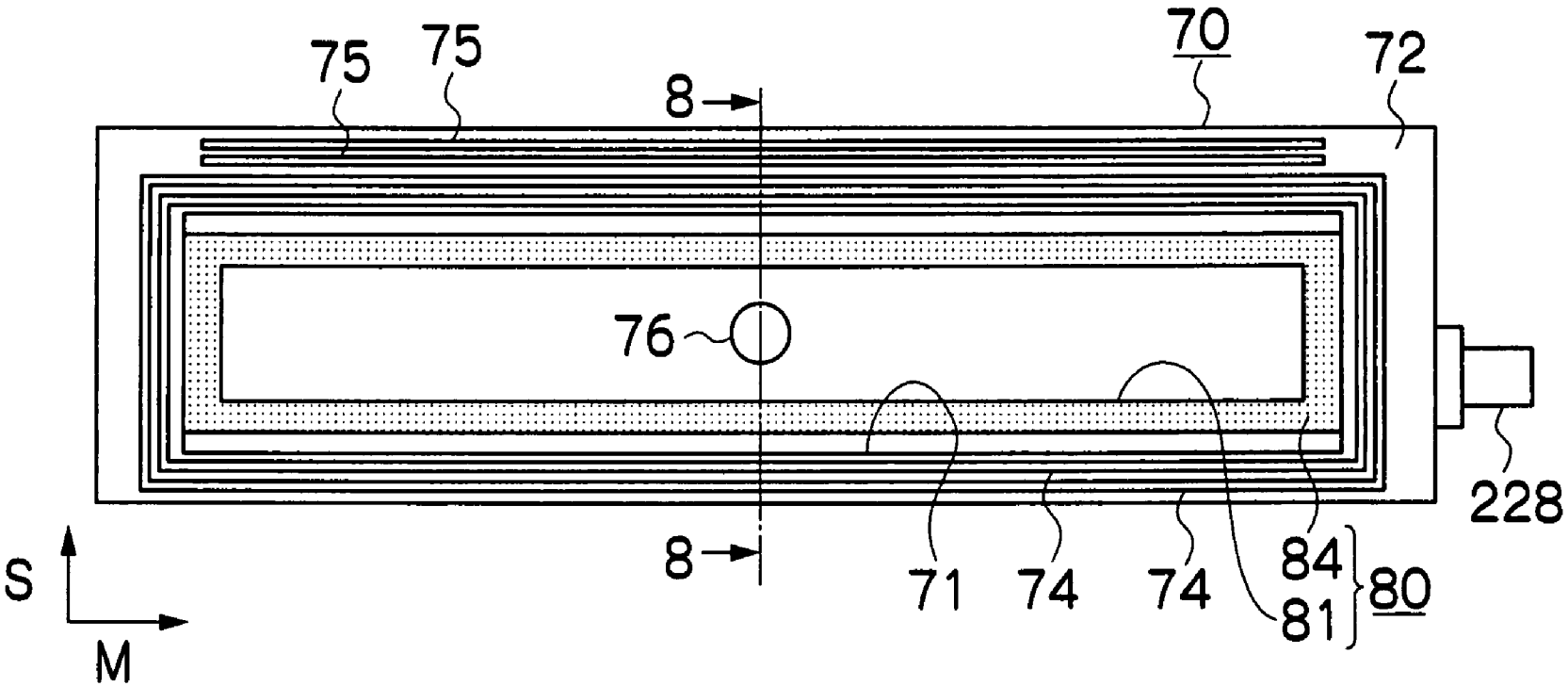
FIG. 7 is a plan diagram showing a liquid receptacle according to an embodiment of the present invention.
Figure 8:
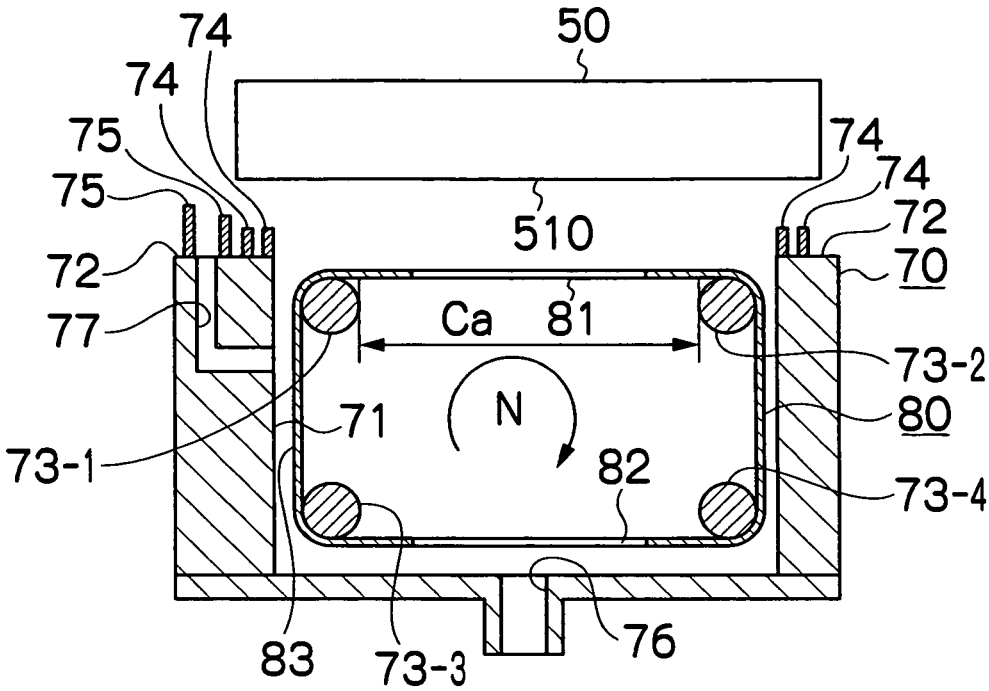
FIG. 8 is a cross-sectional diagram along line 8-8 in FIG. 7.

FIG. 7 is a plan diagram showing one embodiment of the liquid receptacle 70, which can be positioned oppositely to the liquid ejection head 50, as viewed from the side of the nozzle face 510 of the liquid ejection head 50. FIG. 8 is a cross-sectional diagram along line 8-8 in FIG. 7.

The liquid receptacle 70 has a recess part 71, and the suction port 76 is formed in the bottom face of the recess part 71 and is connected to the waste liquid tank 68 through the expulsion flow channel 670. The liquid inside the recess part 71 flows to the waste liquid tank 68 by the gravity force or a suction force applied by the suction pump 67 in the expulsion flow channel 670.

An endless belt 80 is provided in the recess part 71 of the liquid receptacle 70. The belt 80 is suspended about four rollers 73 (73-1, 73-2, 73-3, 73-4), which are disposed along the lengthwise direction of the liquid ejection head 50 (i.e., the main scanning direction), and it is supported rotatably by these rollers 73.

The four rollers 73 are disposed in the recess part 71 of the liquid receptacle 70 in such a manner that they form a quadrilateral shape corresponding to the shape of the recess part 71, in a cross-section perpendicular to the nozzle face 510 of the liquid ejection head 50. The clearance Ca between the first roller 73-1 and the second roller 73-2, which are aligned on the side opposite to the nozzle face 510 (in other words, on the upper side), is greater than the width in the sub-scanning direction of the nozzle arrangement constituted by the two-dimensional arrangement of the plurality of nozzles 51 on the nozzle face 510.

When the four rollers 73 are rotated by means of a motor 228 (belt drive unit) shown in FIG. 7, the belt 80 suspended about the rollers 73 moves in a plane perpendicular to the nozzle face 5 10 of the liquid ejection head 50, in conjunction with the movement of the four rollers 73.

Figure 9:
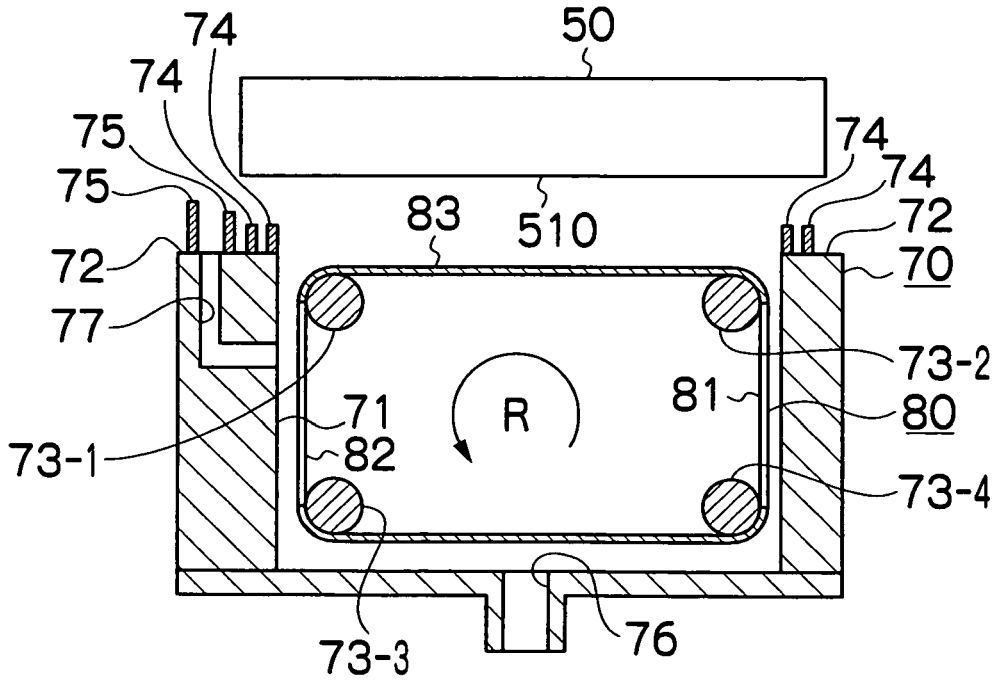
FIG. 9 is a cross-sectional diagram showing a state where the belt has been rotated through a ¼ turn in the liquid receptacle shown in FIG. 8.

FIG. 9 is a diagram showing a state where the belt 80 has been rotated from a state shown in FIG. 8 through approximately ¼ of a turn in the direction denoted by an arrow N, in other words, the state where the belt 80 has been rotated forwards (clockwise in FIGS. 8 and 9) through approximately ¼ of a turn from the state shown in FIG. 8. If the belt 80 is rotated through approximately ¼ of a turn in the direction denoted by an arrow R from the state shown in FIG. 9, in other words, if the belt 80 is rotated in reverse (counter-clockwise in FIGS. 8 and 9) through approximately ¼ of a turn from the state shown in FIG. 9, then the state shown in FIG. 8 is achieved. In this way, the belt 80 can be rotated freely in forward or reverse directions by means of the motor 228 through the rollers 73.

Figure 10:
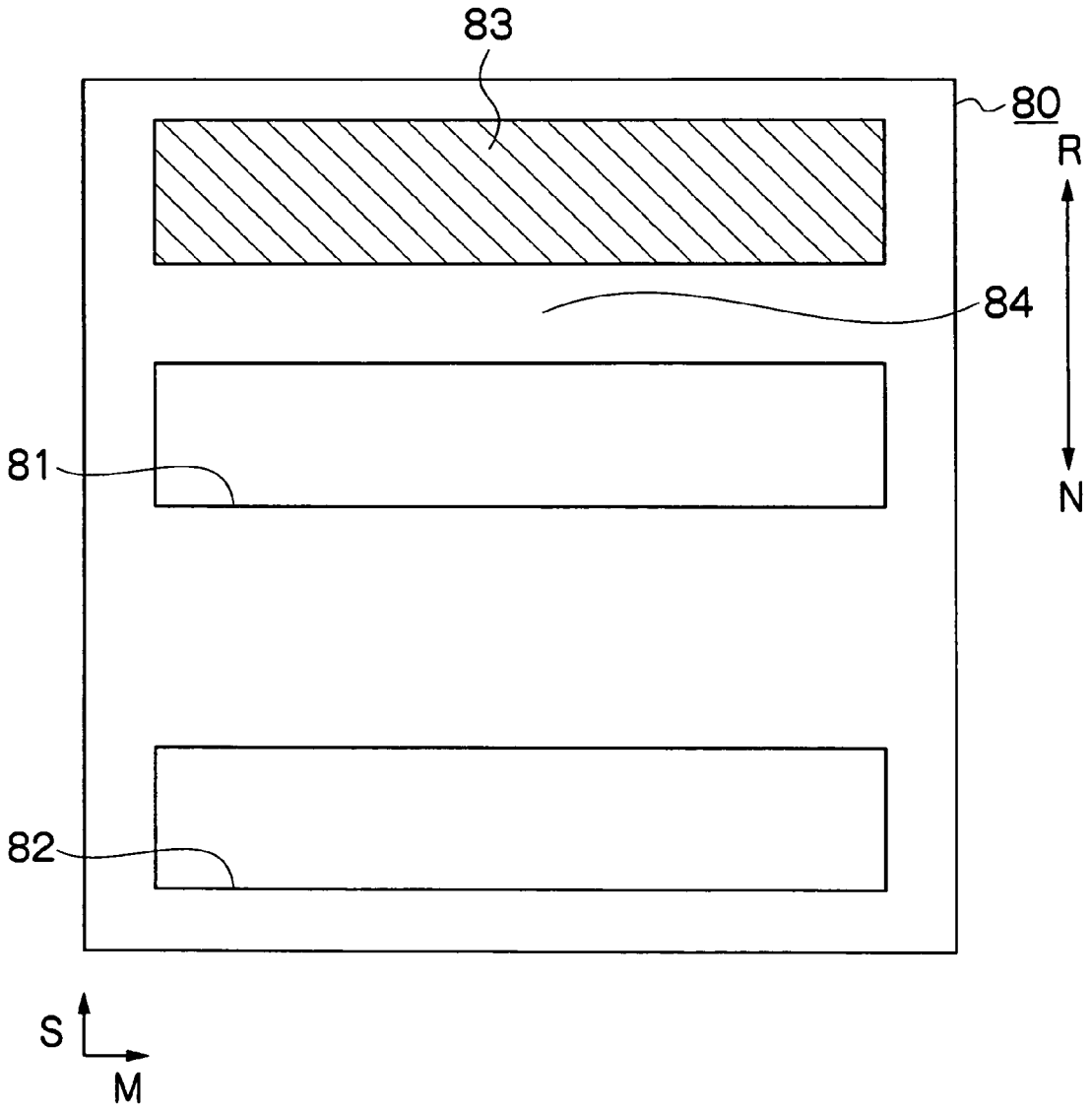
FIG. 10 is a developed view of a belt according to an embodiment of the present invention.

FIG. 10 is a developed view of the belt 80 shown in FIGS. 7 to 9, and shows the outer circumferential surface of the belt 80.

As shown in FIG. 10, the belt 80 has two opening parts 81 and 82. Moreover, a liquid-philic part 83 having liquid-philic properties with respect to the liquid ejected from the nozzles 51 is formed on the external circumferential surface of the belt 80, and a liquid-phobic part 84 having liquid-phobic properties with respect to the liquid ejected from the nozzles 51 is formed so as to surround the liquid-philic part 83. The contact angle of the liquid on the liquid-philic part 83 is smaller than on the liquid-phobic part 84. Furthermore, the contact angle of the liquid on the liquid-philic part 83 is smaller than on the nozzle face 510 having liquid-philic properties.

In the present specification, the term "liquid-philic" means "having a strong affinity for the liquid (e.g., ink)". For example, in the case where the liquid or the ink is an aqueous solution or water-based, the terms "liquid-philic", "liquid-philicity", "liquid-philize" and "liquid-philization" correspond to "hydrophilic", "hydrophilicity", "hydrophilize" and "hydrophilization", respectively; and the antonymous term "liquid-phobic" and its derivatives correspond to "hydrophobic" and its derivatives. On the other hand, in the case where the liquid or the ink is an oleaginous solution or oil-based, the term "liquid-philic" and its derivatives correspond to "oleophilic" and its derivatives; and the term "liquid-phobic" and its derivatives correspond to "oleophobic" and its derivatives.

Figure 13:
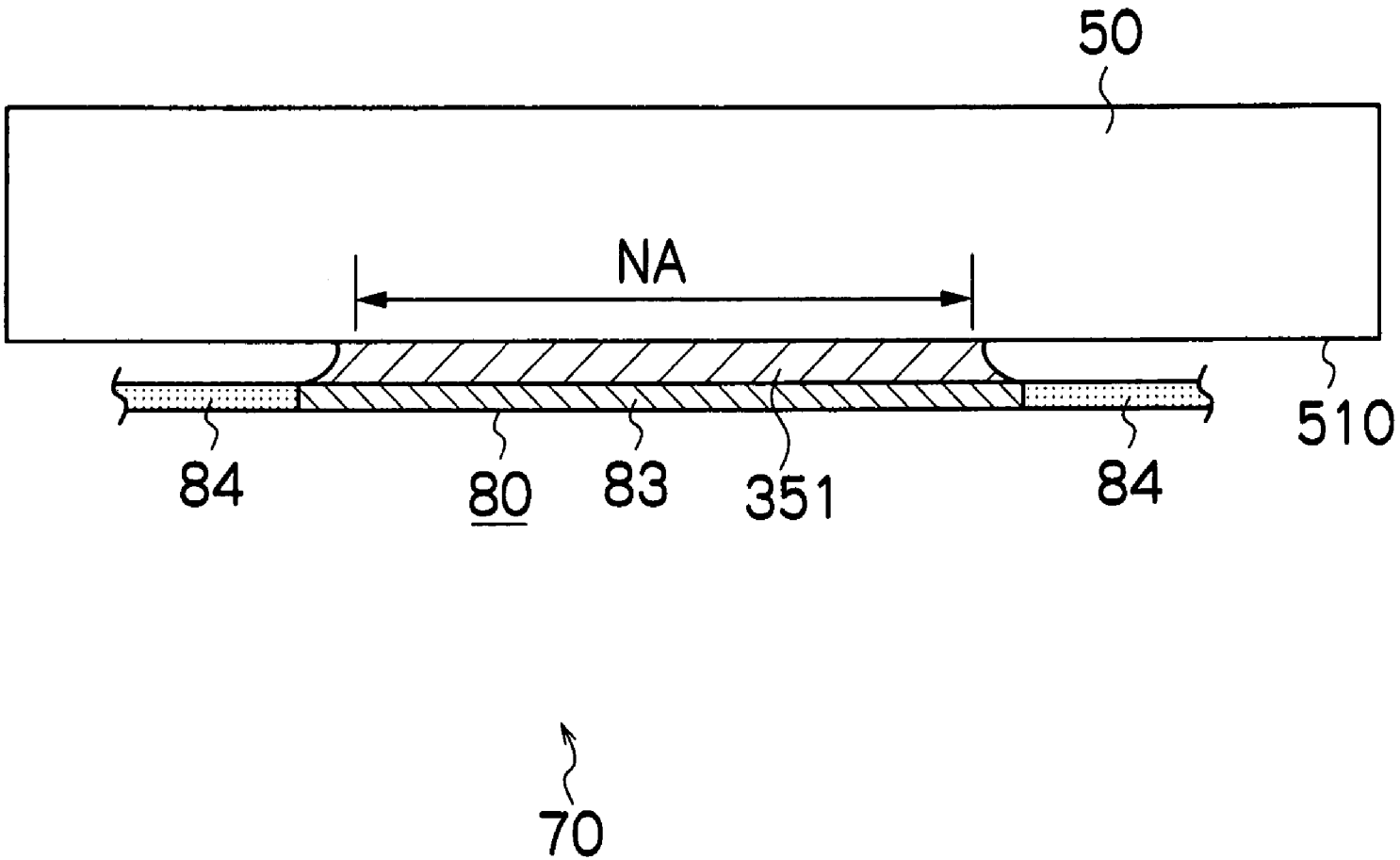
FIG. 13 is a schematic drawing showing a liquid pool.

When the liquid is ejected from the nozzles 51 of the liquid ejection head 50 in the state where the liquid-philic part 83 is opposite to the nozzle face 510 of the liquid ejection head 50, then as shown in FIG. 13, it is possible to form a liquid pool 351 between the liquid-philic part 83 of the liquid receptacle 70 and the nozzle face 510 of the liquid ejection head 50. The liquid-philic part 83 is formed to be wider than the full range NA (nozzle range), in which the nozzles 51 are formed on the nozzle face 510, and it is possible to form a layer-shaped liquid pool 351 over the whole of the nozzle range NA, in other words, so as to cover all of the nozzles 51.

The nozzle face 510 of the liquid ejection head 50 generally has a liquid-phobic surface having liquid-phobic properties. If the liquid-phobic part 84 is positioned oppositely to the liquid-phobic nozzle face 510 when forming the liquid pool 351, then since both of the opposite surfaces have liquid-phobic properties, the liquid pool is destabilized, and hence the liquid moves between the nozzle face 510 and the belt 80 and is liable to spill out. In order to eliminate this problem, even in a case in which the nozzle face 5 10 has liquid-phobic properties, it is possible to stably make the liquid pool 351 of a small quantity of liquid by positioning the liquid-philic part 83 oppositely to the nozzle face 5 10 when forming the liquid pool 351, and hence the liquid is not liable to spill out from the space between the nozzle face 510 and the belt 80.

The cross-sectional area of each of the opening parts 81 and 82 in the belt 80 is greater than the fill range NA (nozzle range) in which the nozzles 51 are formed on the nozzle face 510 of the liquid ejection head 50, and even in cases where the liquid is ejected from all of the nozzles 51, all of the ejected liquid is able to pass through the opening parts 81 and 82.

The belt 80 used is manufactured by impregnating a base material made of weaved fibers with a rubber material, such as silicone. In this case, preferably, a liquid-philic rubber material and a liquid-phobic rubber material are used selectively to form the liquid-philic part 83 and the liquid-phobic part 84 on the external circumferential surface of the belt 80.

It is also possible to manufacture the belt 80 by carrying out a surface treatment to form the liquid-philic part 83 and the liquid-phobic part 84 on a base material made of metal. This method is preferable in that the liquid-philic part 83 and the liquid-phobic part 84 can be formed readily and there is little stretching of the belt 80.

The liquid-philization treatment is a treatment carried out on the belt 80 so that the contact angle of the liquid on the treated surface is smaller than the prescribed angle (for example, 45 degrees or lower). In a case where the contact angle of the liquid on the external circumferential surface of the belt 80 is originally a prescribed angle which shows liquid-philic properties, it is not necessary to carry out liquid-philization treatment.

The liquid-phobization treatment is a treatment carried out on the belt 80 so that the contact angle of the liquid on the treated surface is greater than the prescribed angle (for example, 50 degrees or greater). In a case where the contact angle of the liquid on the external circumferential surface of the belt 80 is originally a prescribed angle which shows liquid-phobic properties, it is not necessary to carry out liquid-phobization treatment.

Furthermore, if the stretching of the belt 80 exceeds a tolerable level, then it is preferable to adopt a composition including a belt tension mechanism in the liquid receptacle 70.

As shown in FIG. 7, the liquid receptacle 70 has sealing members 74 formed in a ring shape on a rim part 72, which surrounds the recess part 71. The sealing members 74 are made of an elastic member, and the cross-sectional shape thereof perpendicular to the nozzle face 510 is a projecting shape as shown in FIG. 8. In a state where the liquid receptacle 70 is pressed against the nozzle face 510 of the liquid ejection head 50, the sealing members 74 are in contact with the nozzle face 510 tightly due to their elastic force, in other words, the sealing members 74 hermetically seal the nozzle face 510 of the liquid ejection head 50 and shut off all of the nozzles 51 from the atmosphere. Consequently, evaporation of the liquid from the liquid ejection head 50 is prevented.

In a case where the distance between the belt 80 and the nozzle face 510 is set to approximately 1 mm, the sealing members 74 have, for example, a height of approximately 2 mm in a free length, and when the sealing members 74 are compressed and bended when pressed, a distance of approximately 1 mm is kept between the belt 80 and the nozzle face 510.

As shown in FIG. 7, wipers 75 are formed on the rim part 72 of the liquid receptacle 70 along the main scanning direction M, in other words, following a direction substantially perpendicular to the sub-scanning direction S (medium conveyance direction), in which the liquid receptacle 70 is moved horizontally with respect to the liquid ejection head 50. The wipers 75 are made of an elastic member, and the cross-sectional shape thereof perpendicular to the nozzle face 510 is a projecting shape as shown in FIG. 8. When the liquid receptacle 70 is moved horizontally with respect to the liquid ejection head 50 in the sub-scanning direction S, the wipers 75 of the liquid receptacle 70 slide over the nozzle face 510 of the liquid ejection head 50 in the sub-scanning direction S, thereby wiping away the liquid, and the like, on the nozzle face 510.

The liquid wiped away from the nozzle face 510 flows toward the bottom of the recess part 71, either directly or through a liquid guiding channel 77 connecting the rim part 72 of the liquid receptacle 70 with the side wall of the recess part 71.

The wipers are not limited in particular to the composition where they are formed on the rim part 72 of the liquid receptacle 70, and it is also possible to form the wipers on the belt 80.

Figure 11:
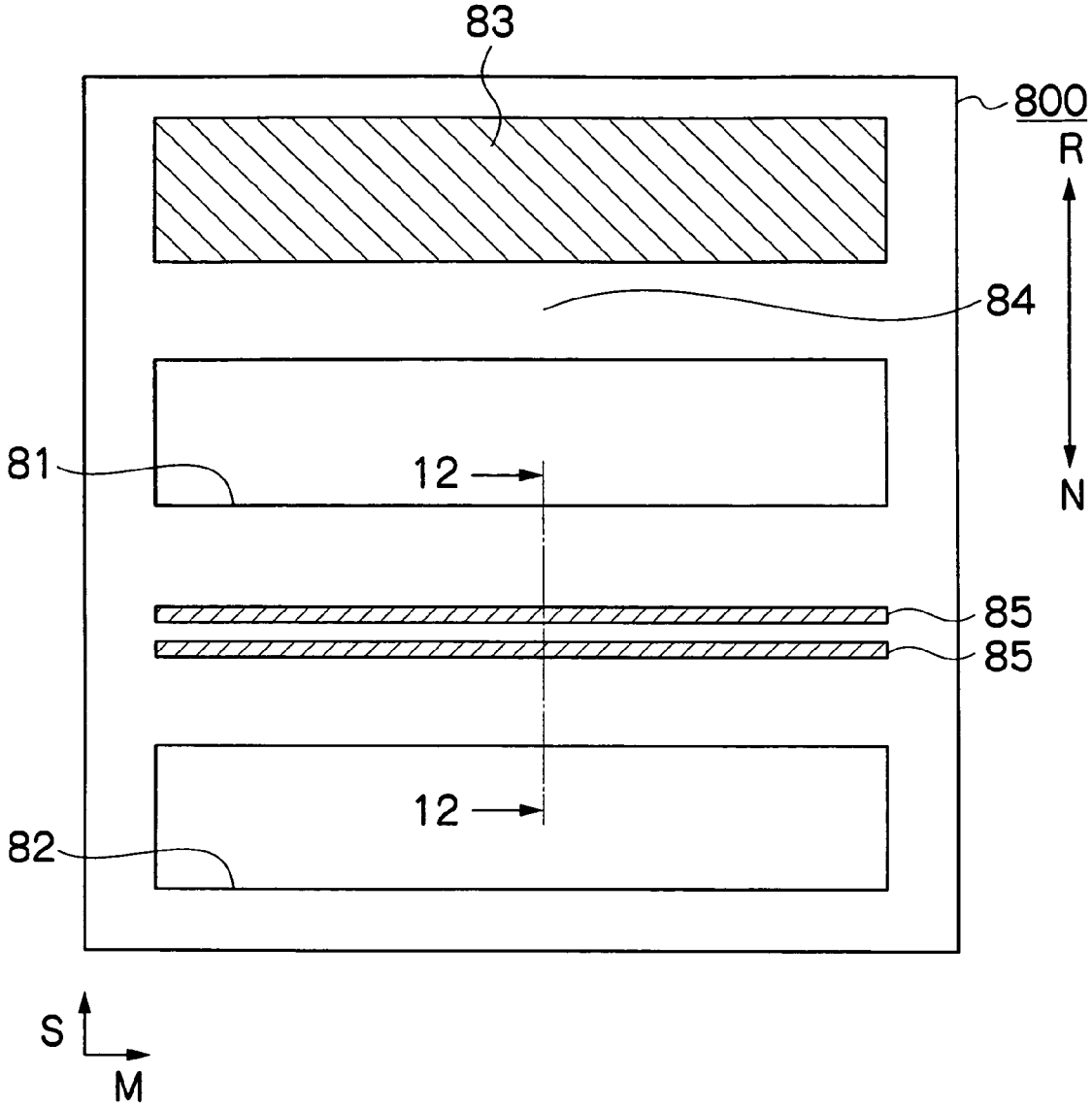
FIG. 11 is a developed view of a belt according to another embodiment of the present invention.
Figure 12:
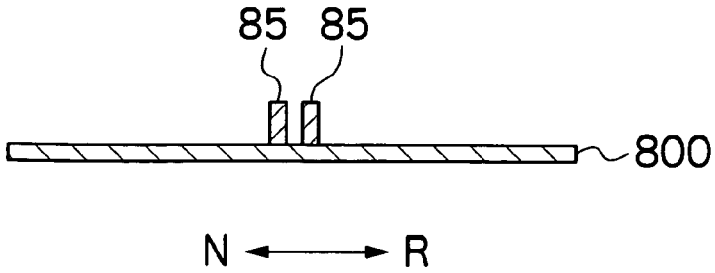
FIG. 12 is a cross-sectional diagram along line 12-12 in FIG. 11.

FIG. 11 is a developed view of a belt 800 provided with wipers 85. In FIG. 11, the constituent elements that are the same as the constituent elements of the belt 80 shown in FIG. 10 are denoted with the same reference numerals as FIG. 10, and contents described above are omitted from the following description. FIG. 12 is a cross-sectional diagram along line 12-12 in FIG. 11.

In the present embodiment, the projection-shaped wipers 85 are formed along the main scanning direction M on the liquid-phobic part 84 of the belt 800.

By adopting the composition in which the wipers 85 are provided on the belt 800 in this way, the wiping of the nozzle face 510 is carried out by means of the rotation of the belt 800, and the mechanism can be simplified in comparison with the composition in which the wipers 75 are provided on the rim part 72 of the liquid receptacle 70 as shown in FIG. 10. More specifically, in the composition in which the wipers 75 are formed on the rim part 72 of the liquid receptacle 70 as shown in FIGS. 7 and 8, it is necessary to provide the mechanism for moving the liquid receptacle 70 and/or the liquid ejection head 50 precisely in parallel relatively to each other, in such a manner that the liquid does not drop out from the liquid receptacle 70. On the other hand, in the case of the composition where the wipers 85 are formed on the external circumferential surface of the belt 800 as shown in FIGS. 11 and 12, it is sufficient to rotate the belt 800 through the rollers 73 by means of the motor 228. Moreover, in the composition where the wipers 75 are disposed on the rim part 72 of the liquid receptacle 70 as described above, in order to prevent the liquid from dropping out from the liquid receptacle 70, essentially, a unidirectional sweeping motion is adopted. On the other hand, according to the composition of the present embodiment in which the wipers 85 are disposed on the belt 800, it is possible to move the wipers 85 back and forth reciprocally over the nozzle face 510 through forward rotation and reverse rotation of the belt 800. In other words, the freedom of the sweeping direction is increased, and hence wiping can be carried out efficiently.

System Composition of Image Forming Apparatus

Figure 14:
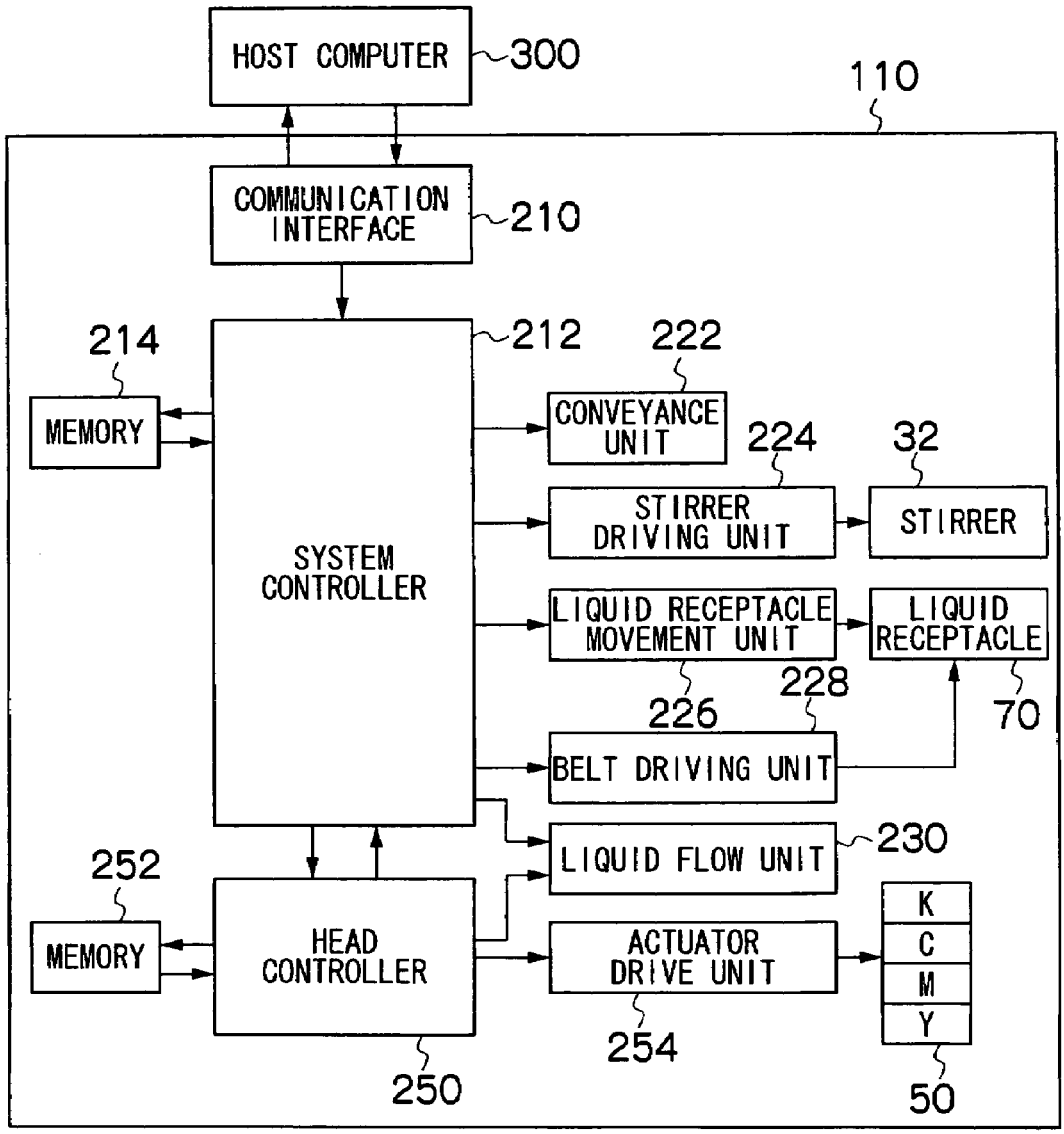
FIG. 14 is a block diagram showing the general composition of the image forming apparatus.

FIG. 14 is a block diagram showing one embodiment of the system composition of the image forming apparatus 110.

As shown in FIG. 14, the image forming apparatus 110 principally includes: the stirrer 32 in the main tank 60 as shown in FIGS. 5 or 6; the liquid ejection head 50 as shown in FIGS. 1 and 2; the liquid receptacle 70 as shown in FIGS. 7 to 9; a communication interface 210, which performs communications with a host computer 300; a system controller 212, which performs overall control of the image forming apparatus 110; memories 214 and 252; the conveyance unit 222, which conveys an ejection receiving medium; the stirrer drive unit 224, which drives the stirrer 32; the liquid receptacle movement unit 226, which moves the liquid receptacle 70; the belt drive unit 228, which drives the belt 80 in the liquid receptacle 70; a liquid flow unit 230, which drives the flow of the liquid; a head controller 250, which performs control relating to the liquid ejection head 50; and an actuator drive unit 254, which drives the actuators 58 of the liquid ejection head 50.

In FIG. 12, the second memory 252 is depicted as being appended to the head controller 250; however, it can be combined with the first memory 214. Also possible is a mode in which the head controller 250 and the system controller 212 are integrated to form a single micro-processor.

The image forming apparatus 110 has the plurality of liquid ejection heads 50, which constitute the liquid ejection unit 112 shown in FIG. 3 and respectively eject inks of the colors of black (K), cyan (C), magenta (M) and yellow (Y).

The communication interface 210 is an image data input device for receiving image data transmitted by a host computer 300. For the communication interface 210, a wired or wireless interface, such as a USB (Universal Serial Bus), IEEE 1394, or the like, can be used. The image data acquired by the image forming apparatus 110 through the communication interface 210 is stored temporarily in a first memory 214 for storing image data.

The system controller 212 is constituted by a microcomputer and peripheral circuits thereof, and the like, and it forms a main control device which controls the whole of the image forming apparatus 110 in accordance with a prescribed program. More specifically, the system controller 212 controls units of the communication interface 210, the conveyance unit 222, the stirrer drive unit 224, the liquid receptacle movement unit 226, the belt drive unit 228, the liquid flow unit 230, the head controller 250, and the like.

The conveyance unit 222 comprises a conveyance motor and driver circuit for same, and it conveys the recording medium 116 by using the rollers 131 and 132 and the belt 133 shown in FIG. 3, under the control of the system controller 212. In other words, by means of the conveyance unit 222, the liquid ejection heads 50 and the recording medium 116 move relatively to each other.

The stirrer drive unit 224 drives and rotates the stirrer 32, which serves as the liquid agitating device, in the main tank 60 under the control of the system controller 212, thus agitating the liquid in the main tank 60. The stirrer drive unit 224 has a function for changing the direction of rotation of the stirrer 32 and the speed of rotation of same, with time, under the control of the system controller 212.

The liquid receptacle movement unit 226 is constituted by a mechanism and a circuit which perform two-directional movement, namely, horizontal movement, in which the liquid receptacle 70 is moved in the medium conveyance direction (sub-scanning direction), and vertical movement, in which the liquid receptacle 70 is moved perpendicularly with respect to the nozzle face 510 of the liquid ejection head 50, under the control of the system controller 212.

The belt drive unit 228 is constituted by a mechanism and a circuit which move the belt 80 in the liquid receptacle 70, under the control of the system controller 212. The belt drive unit 228 causes the belt 80 to rotate under the control of the system controller 212, thereby switching between a state where the opening section 81 of the belt 80 is opposite to the nozzle face 510 of the liquid ejection head 50 and a state where the liquid-philic part 83 of the belt 80 is opposite to the nozzle face 5 10 of the liquid ejection head 50.

The liquid flow unit 230 is constituted by the main tank 60, the sub-tank 61, the liquid supply pump 62, the liquid circulation pump 64, the suction pump 67, the waste liquid tank 68, the electromagnetic valves 41 to 44, the flow channels 600, 610, 620, 630 and 640 between the main tank 60 and the liquid ejection head 50, and the flow channel 670 between the liquid receptacle 70 and the waste liquid tank 68, as shown in FIG. 5 or 6. The electromagnetic valves 41 to 44 and the pumps 62, 64 and 67, which constitute a part of the liquid flow unit 230, are controlled by the system controller 212 and the head controller 250.

The actuator drive unit 254 applies drive signals to the actuators 58 of the liquid ejection head 50 shown in FIG. 2, under the control of the head controller 250, which operates in accordance with instructions from the system controller 212. More specifically, the actuator drive unit 254 serves as a drive device that drives the actuators of the liquid ejection head 50, when ejecting the liquid from the nozzles of the liquid ejection head 50, and when agitating the liquid in the liquid ejection head 50. There are various conditions of the drive signals (drive conditions), and typical embodiments thereof are described later in detail.

The head controller 250 is constituted by a microcomputer and peripheral circuits thereof, and the like, and it forms a control device which controls the liquid ejection heads 50 through the actuator drive unit 254 in accordance with a prescribed program.

The head controller 250 generates data (dot data), which is required when forming dots on a recording medium 116 by ejecting liquid toward the recording medium 116 from the liquid ejection heads 50 on the basis of the image data input to the image forming apparatus 110. More specifically, the head controller 250 is a control unit that functions as an image processing device carrying out various image treatment processes, corrections, and the like, in order to generate dot data from the image data stored in the first memory 214, in accordance 5 with the control of the system controller 212, and the head controller 250 supplies the dot data thus generated to the actuator drive unit 254. When the dot data is supplied to the actuator drive unit 254, drive signals are output to the actuators 58 of the liquid ejection heads 50 from the actuator drive unit 254 according to the dot data, and liquid is ejected from the nozzles 51 of the liquid ejection heads 50 toward the recording medium 116. 10 Furthermore, various maintenance processes for maintaining the state of the liquid inside the liquid ejection head 50 are controlled by the system controller 212 and the head controller 250.

Maintenance Processes Using Liquid Receptacle

The image forming apparatus 110 according to the present embodiment performs various maintenance processes using the liquid receptacle 70, under the control of the system controller 212.

Firstly, the liquid receptacle 70 is used for a liquid agitation process, which agitates the liquid inside the liquid ejection head 50.

Figure 15A:
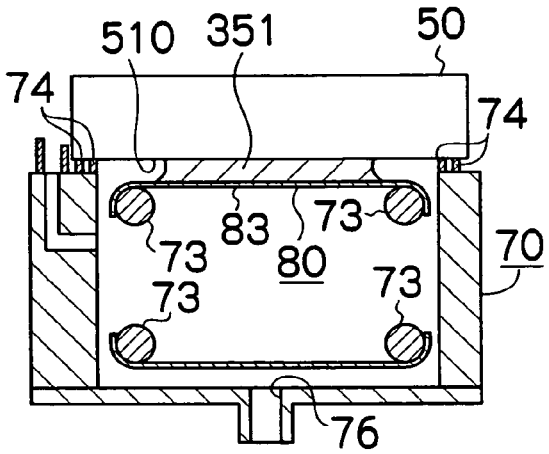
FIGS. 15A to 15E are diagrams showing a maintenance process using a liquid receptacle.

The liquid receptacle 70 is located in a prescribed standby position during image formation. When agitating the liquid with the liquid receptacle 70, then as shown in FIG. 15A, the liquid receptacle 70 is moved horizontally from the prescribed standby position to the position opposite to the nozzle face 510 of the liquid ejection head 50 and is also moved vertically in such a manner that the liquid-philic part 83 of the liquid receptacle 70 and the nozzle face 510 form a prescribed clearance for forming a liquid pool. Moreover, the belt 80 of the liquid receptacle 70 is rotated in such a manner that the liquid-philic part 83 of same is opposite to the nozzle face 510. Then, for example, the liquid inside all of the pressure chambers 52 is ejected from all of the nozzles 51 by driving all of the actuators 58 of the liquid ejection head 50. A layer-shaped liquid pool 351 is thereby formed between the liquid-philic part 83 of the liquid receptacle 70 and the nozzle face 510 of the liquid ejection head 50. The liquid pool 351 is not limited to being formed by driving all of the actuators 58, and it can also be formed by driving a selected plurality of actuators 58. Next, the liquid agitation process described later is carried out.

During agitation of the liquid, the liquid-philic part 83 is surrounded by the liquid-phobic part 84 as described above in such a manner that the liquid pool 351 formed between the belt 80 and the nozzle face 510 does not flow out from the space between the belt 80 and the nozzle face 510, and leakage is prevented by the sealing members 74 to avoid outflow of the liquid from the liquid receptacle 70. The amount of the liquid consumed during the liquid agitation is hence reduced.

The liquid agitation process may also be carried out with forming no liquid pool 351, and a mode of this kind where no liquid pool 351 is formed is described later in detail.

Secondly, the liquid receptacle 70 is used in a capping process, which hermetically seals (caps) the nozzle face 510 so as to prevent evaporation of the liquid from the nozzles 51 of the liquid ejection head 50.

Figure 15D:
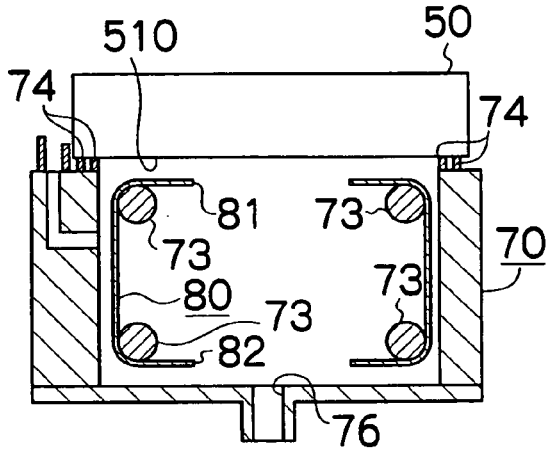
Figure 15B:
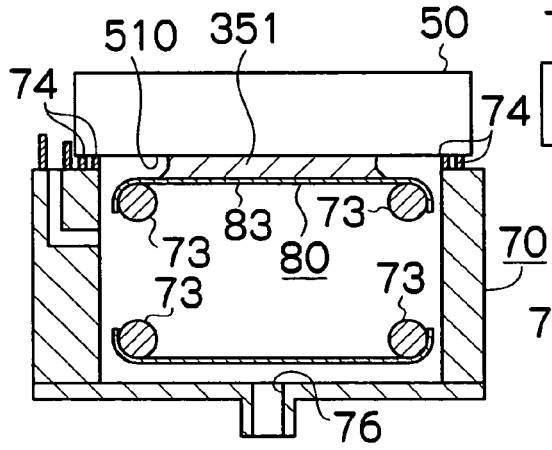

During capping, similarly to the case of the liquid agitation using the liquid receptacle 70, the layer-shaped liquid pool 351 is formed between the liquid-philic part 83 of the liquid receptacle 70 and the nozzle face 510 of the liquid ejection head 50 as shown in FIG. 15B, and furthermore, the whole of the nozzle area and the whole of the liquid pool is covered by the sealing members 74.

Thirdly, the liquid receptacle 70 is used in a dummy ejection process (which is also referred to as "purging") which performs dummy ejection of the liquid from the nozzles 51 of the liquid ejection head 50.

The liquid receptacle 70 is located at the prescribed standby position during image formation. When performing dummy ejection, then as shown in FIG. 15C, the liquid receptacle 70 is moved horizontally from the prescribed standby position to the position opposite to the nozzle face 510 of the liquid ejection head 50 and the belt 80 of the liquid receptacle 70 is rotated in such a manner that one of the opening parts (81 or 82) of the belt 80 is opposite to the nozzle face 510. Thereby, the other of the opening parts (82 or 81) of the liquid receptacle 70 is in a state where it is opposite to the bottom of the liquid receptacle 70 (in other words, a state where it is opposite to the suction port 76). Then, the liquid inside the pressure chambers 52 is ejected from the nozzles 51 by driving the actuators 58 of the liquid ejection head 50. Thereupon, the liquid ejected from the nozzles 51 of the liquid ejection head 50 passes through both of the opening parts 81 and 82, reaches the bottom of the liquid receptacle 70, and is then sent to the waste liquid tank 68 through the suction port 76 formed in the bottom of the liquid receptacle 70. By performing the dummy ejection in this way, the liquid of increased viscosity inside the liquid ejection head 50, dust adhering to the nozzles 51, and the like, are cleaned away.

Fourthly, the liquid receptacle 70 is used in a suction process, which suctions liquid, and the like, from the nozzles 51 of the liquid ejection head 50.

The liquid receptacle 70 is located in the prescribed standby position during image formation. When a suction process is carried out using the liquid receptacle 70, then as shown in FIG. 15D, the liquid receptacle 70 is moved horizontally from the prescribed standby position to the position opposite to the nozzle face 510 of the liquid ejection head 50 and is also moved vertically in such a manner that the sealing members 74 of the liquid receptacle 70 hermetically seal the nozzle face 510 of the liquid ejection head 50. Moreover, the belt 80 of the liquid receptacle 70 is rotated in such a manner that one of the opening parts (81 or 82) of the belt 80 is opposite to the nozzle face 510. Then, the suction pump 67 is driven. By performing the suction in this way, mater that is difficult to remove by the dummy ejection described above, for example, semi-solid mater or solid mater caused by the liquid increasing in viscosity and sedimentation inside the nozzles 51, is suctioned by the suction-pump 67 through the liquid receptacle 70, together with the liquid.

Fifthly, the liquid receptacle 70 is used in a wiping process, which wipes the nozzle face 510 of the liquid ejection head 50.

Figure 15E:
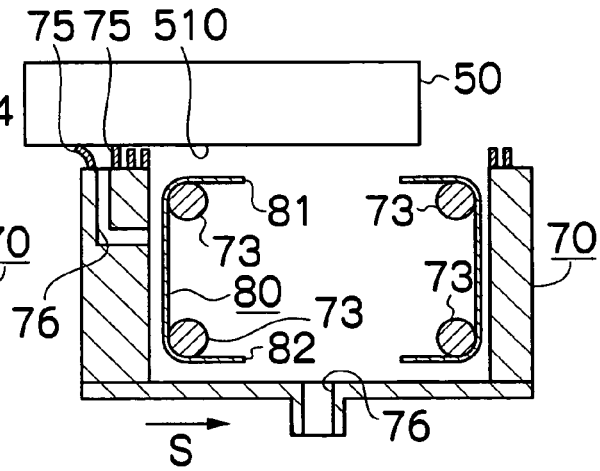
Figure 15C:
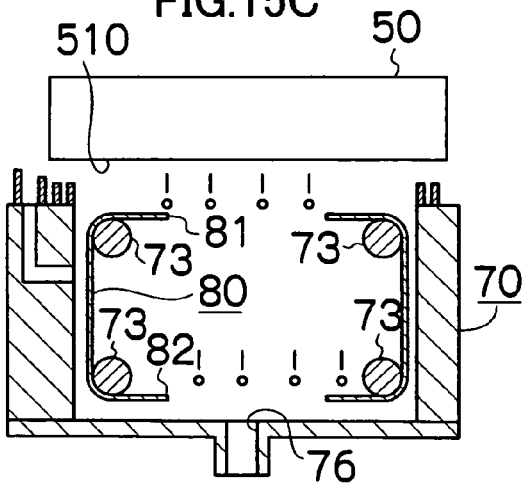

FIG. 15E shows a case where the wipers 75 formed on the rim part 72 of the liquid receptacle 70 shown in FIGS. 7 to 9 slide over the nozzle face 510. More specifically, the liquid receptacle 70 is moved in the sub-scanning direction S in a state where the wipers 75 are in contact with the nozzle face 510 of the liquid ejection head 50.

Although the embodiment is shown in FIGS. 8 and 9 in which the two opening parts 81 and 82 having the same opening cross-sectional area are provided, the present invention is not limited in particular to a case of this kind, and the sizes of the two opening parts 81 and 82 may be different from each other.

However, it is necessary to adopt a composition where the opening part that is opposite to the nozzle face 510 during the dummy ejection has at the least an opening cross-sectional area greater than the whole region (nozzle region) in which the nozzles 51 of the nozzle face 510 are formed. Hence, since all of the liquid ejected from the nozzles 51 is able to pass through the opening section, then splashing of the liquid from the belt 80 is prevented.

On the other hand, the opening part that is opposite to the nozzle face 510 during the suction may have a cross-sectional area of a size corresponding to the whole of the nozzle region in the nozzle face 510, or a cross-sectional area of a size corresponding to a portion of the nozzle region. In a case where the opening part has a size corresponding to a portion of the nozzle region, then the suction force is increased in comparison with a case where the opening part has a size corresponding to the whole of the nozzle region.

Liquid Agitation Processes

The liquid to be subject to the liquid agitation processing in the image forming apparatus 110 includes the following portions: a first portion inside the liquid ejection head 50, a second portion inside the tank, such as the main tank 60 or the sub-tank 61, and a third portion inside the flow channels connecting the main tank 60 with the liquid ejection head 50.

There are various types of the liquid agitation processes for agitating these portions of the liquid. Modes for achieving a large liquid agitation effect are described below: a first mode where the portion of the liquid inside the liquid ejection head 50 is agitated in a state where the free surface of the liquid in the nozzles 51 has been withdrawn toward the pressure chamber 52 side; a second mode where the portion of the liquid inside the liquid ejection head 50 is agitated in a state where a liquid pool has been formed between the liquid ejection head 50 and the liquid receptacle 70; and a third mode where the portion inside the liquid ejection head 50, the portion inside the sub-tank 61 and the portion inside the flow channels between the main tank 60 and the liquid ejection head 50 are all returned into the main tank 60 and the whole liquid is then agitated inside the main tank 60.

First Liquid Agitation Mode: Mode Withdrawing Free Surface of Liquid

In the first mode, the free surface of the liquid positioned in the vicinity of the nozzle face 510 in the nozzles 51 of the liquid ejection head 50 is withdrawn toward the pressure chamber 52 side, and then the actuators 58 used for liquid ejection in the liquid ejection head 50 are driven and the diaphragm 503 is caused to vibrate, so that the liquid inside the ejection head 50 can be agitated efficiently.

One embodiment of the liquid agitation process carried out by withdrawing the free surface of the liquid in this way is described.

Figure 16:
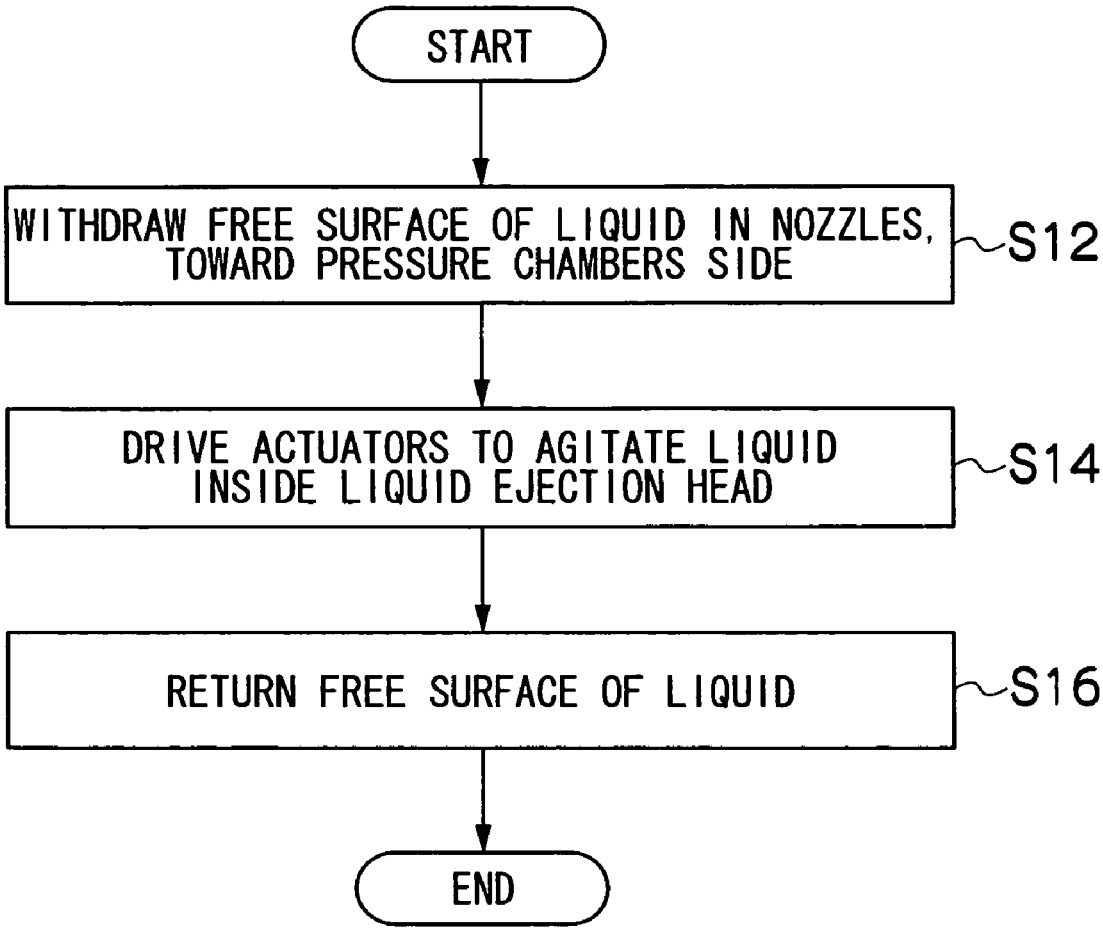
FIG. 16 is an approximate flowchart showing an embodiment of a sequence of a liquid agitation process performed by withdrawing the free surface of the liquid.
Figure 17A:
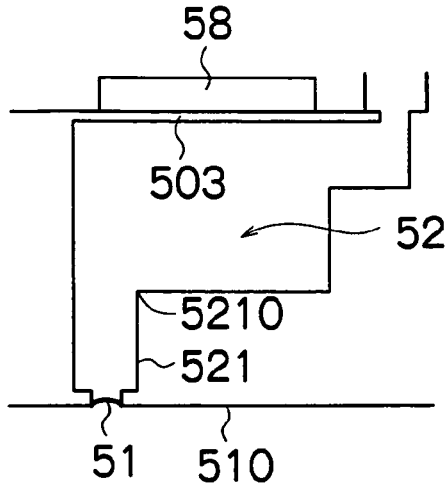
FIGS. 17A to 17C are schematic drawings showing the free surface position.

After completing liquid ejection, the free surface of the liquid in the nozzles 51 of the liquid ejection head 50 is in a state where it is positioned in the vicinity of the nozzle face 510, as shown in FIG. 17A. In this state, the liquid agitation process shown in the flowchart shown in FIG. 16 is started.

In FIG. 16, firstly, the free surface of the liquid having been positioned in the vicinity of the nozzle face 510 inside the nozzle 51 of the liquid ejection head 50 is withdrawn toward the pressure chamber 52 side (step S12).

Figure 17B:
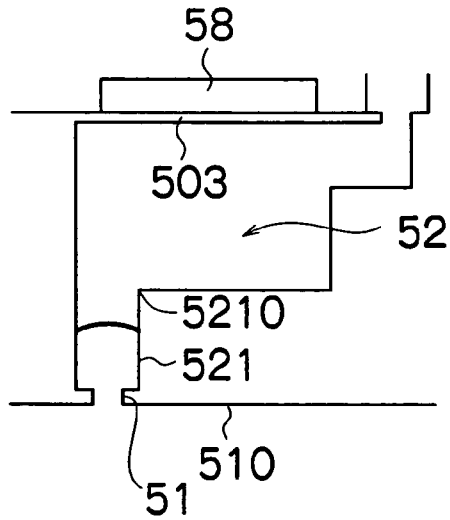
Figure 17C:
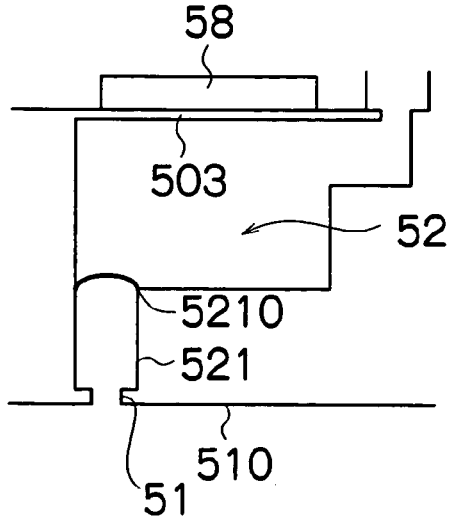

More specifically, by adjusting the amount of the liquid inside the liquid ejection head 50, the free surface of the liquid having been positioned in the vicinity of the nozzle face 510 as shown in FIG. 17A is withdrawn to a position within an ejection flow channel 521 between the pressure chamber 52 and the nozzle 51 as shown in FIG. 17B. It is also preferable that the free surface of the liquid is withdrawn to the boundary between the pressure chamber 52 and the ejection flow channel 521 (in other words, to a connection port 5210, which is the inlet port to the ejection flow channel 521 from the pressure chamber 52) as shown in FIG. 17C.

In the liquid flow system shown in FIG. 5, the first electromagnetic valve 41 in the first liquid returning flow channel 610 connecting the opening section 611 in the bottom of the sub-tank 61 to the main tank 60 is opened for a prescribed period of time so as to move the liquid in the sub-tank 61 to the main tank 60 by a prescribed amount in accordance with the amount of withdrawal of the free surface of the liquid in the liquid ejection head 50, and the liquid is thereby made to flow from the liquid ejection head 50 to the sub-tank 61, thus withdrawing the free surface of the liquid. In other words, the free surface of the liquid is withdrawn through the so-called siphon effect caused by the differential (head differential) between the height of the nozzle face 510 and the height of the free surface of the liquid in the sub-tank 61, with reference to the highest point of the flow channel 630 between the liquid ejection head 50 and the sub-tank 61.

Alternatively, in the liquid flow system shown in FIG. 6, the third electromagnetic valve 43 in the second liquid supply flow channel 630, which supplies the liquid from the sub-tank 61 to the liquid ejection head 50, is closed and the fourth electromagnetic valve 44 in the circulation flow channel 640, which returns the liquid from the liquid ejection head 50 to the sub-tank 61, is opened, then the liquid circulation pump 64 is driven in a direction for removing the liquid from the liquid ejection head 50 to the sub-tank 61 for a prescribed period of time so as to move the liquid in the liquid ejection head 50 to the sub-tank 61 by a prescribed amount in accordance with the amount of withdrawal of the free surface of the liquid in the liquid ejection head 50. The free surface of the liquid is thus withdrawn, and the fourth electromagnetic valve 44 is then closed. By adopting the method in which the free surface of the liquid is withdrawn with the pump, it is possible to control the displacement of the free surface of the liquid precisely by finely controlling the driving of the pump.

In the state where the free surface of the liquid in the nozzles 51 has been withdrawn as described above, the actuators 58 of the liquid ejection head 50 are driven so as to vibrate the liquid inside the pressure chambers 52 through the diaphragm 503, and the liquid inside the liquid ejection head 50 is thereby agitated (step S14).

Thereupon, the free surface of the liquid in the nozzles 51 that has been withdrawn is returned to its original position, in other words, to the position in the vicinity of the nozzle face in the nozzles 51 (step S16).

In the liquid flow system shown in FIG. 5, the free surface of the liquid in the nozzles 51 is returned to its original position by causing the liquid to flow from the sub-tank 61 into the liquid ejection head 50, by driving the liquid supply pump 62 for a prescribed period of time and thereby supplying a prescribed amount of the liquid corresponding to the return amount of the free surface in the nozzles 51, from the main tank 60 to the sub-tank 61.

In the liquid flow system shown in FIG. 6, it is also possible to return the free surface of the liquid in the nozzles 51 to its original position by opening the third electromagnetic valve 43 and driving the liquid circulation pump 64 for a prescribed period of time in a direction for supplying the liquid from the sub-tank 61 to the liquid ejection head 50, thereby causing a prescribed amount of the liquid corresponding to the return amount of the free surface in the nozzles 51 to flow from the sub-tank 61 into the liquid ejection head 50. Moreover, similarly to the liquid flow system shown in FIG. 5, it is also possible to return the free surface in the nozzles 51 to its original position by using the liquid supply-pump 62.

According to the above-described liquid agitation process performed by withdrawing the free surface of the liquid in the nozzles 51, the amplitude of the drive signal applied to the actuators 58 can be raised, the displacement of the liquid inside the pressure chambers 52 can be increased, and hence the liquid inside the pressure chambers 52 can be agitated with good efficiency in a short period of time, compared to a liquid agitation method of the related art in which the free surface of the liquid is vibrated slightly in a state where it is positioned in the vicinity of the nozzle face 510 in the nozzles 51.

There are various conditions of the drive signal (drive conditions) applied to the actuators 58 when agitating the liquid inside the liquid ejection head 50, and two typical embodiments of same (drive condition 1 and drive condition 2) are described below.

Drive Condition 1

As a drive signal for liquid agitation, a drive signal having substantially the same frequency and amplitude as the drive signal applied to the actuators 58 for the liquid ejection, in other words, a drive signal having substantially the same waveform as during the liquid ejection, is applied to the actuators 58.

In the liquid agitation process according to the present embodiment, since the actuators 58 are driven after the free surface of the liquid having been positioned in the vicinity of the nozzle face 510 in the nozzles 51 of the liquid ejection head 50 is withdrawn toward the pressure chamber 52 side as described above, then it is possible to agitate the liquid efficiently without causing the liquid ejection from the nozzles 51, even if the drive signal of substantially the same waveform as the drive signal for the liquid ejection is applied to the actuators 58.

In a case where the drive signal of substantially the same waveform as the drive signal for the liquid ejection is used, it is not necessary to provide a drive signal having a new waveform, and hence the composition of the drive circuit can be simplified.

In order to improve the liquid agitation efficiency yet further, it is possible to drive the actuators 58 under a drive condition where the displacement of the free surface of the liquid in the nozzles 51 and the movement of the micro-particles in the liquid are greater than during the liquid ejection. Moreover, since the resonance frequency of the liquid in the region composed of the pressure chamber 52, the supply side, and the ejection side, is altered by the withdrawal of the free surface of the liquid in the nozzles 51, then the actuators 58 can be driven under a drive condition where the displacement is greater than during the liquid ejection and no liquid ejection occurs.

Drive Condition 2

A drive signal having a sweeping frequency is applied to the actuators 58 as a drive signal for the liquid agitation.

Figure 18:
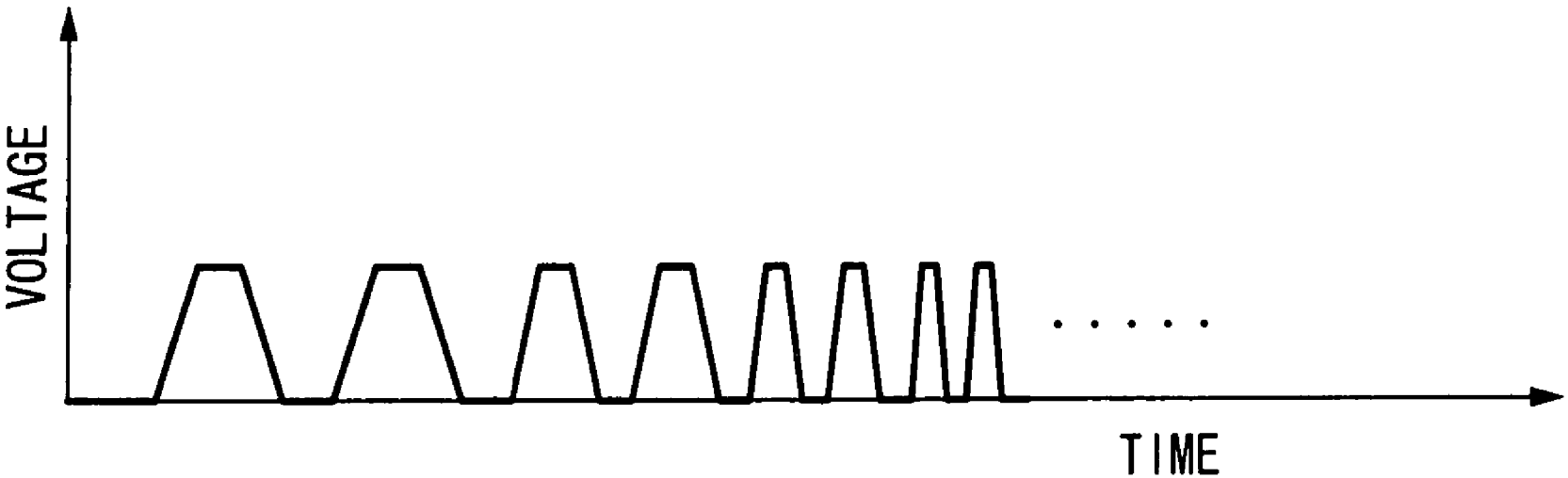
FIG. 18 is a waveform diagram showing an embodiment of an actuator drive signal for liquid agitation.

In this case, a simple waveform, such as a sinusoidal wave or a rectangular wave can be used, so that the composition of the drive circuit can be simplified, and hence costs can be restricted. For example, the rectangular drive signal shown in FIG. 18 is applied to the actuators 58. The drive signal shown in FIG. 18 is subjected to a frequency sweep as steadily changing frequency over time from a low frequency to a high frequency. In other words, the cycles of the signal (the time intervals between pulses in FIG. 18) are steadily changed with time from a long cycle to a short cycle.

In the frequency sweep, the frequency is changed continuously, or in steps (for example, by intervals of several kilohertzs (kHz)), over a broad frequency range (for example, a frequency range from several kilohertzs to several tens kilohertzs).

As described above, the drive signal having the sweeping frequency is applied to the actuators 58, in other words, the vibration with sweeping the frequency is applied to the liquid. Therefore, although the effective frequency for aggregated material, which is generally formed by micro-particles in the liquid (for example, aggregated material caused by aggregation and sedimentation of the coloring material in the ink), varies depending on the size and aggregation conditions, it is possible to obtain effective agitation effects while using the standardized waveform for the drive signal.

Second Liquid Agitation Mode: Mode Forming Liquid Pool

In the second mode, the liquid pool is formed between the nozzle face 510 of the liquid ejection head 50 and the belt 80 of the liquid receptacle 70, and then the actuators 58 used for liquid ejection in the liquid ejection head 50 are driven and the diaphragm 503 is caused to vibrate, so that the liquid inside the liquid ejection head 50 is agitated.

One embodiment of the liquid agitation process carried out by forming the liquid pool in this way is described.

Figure 19:
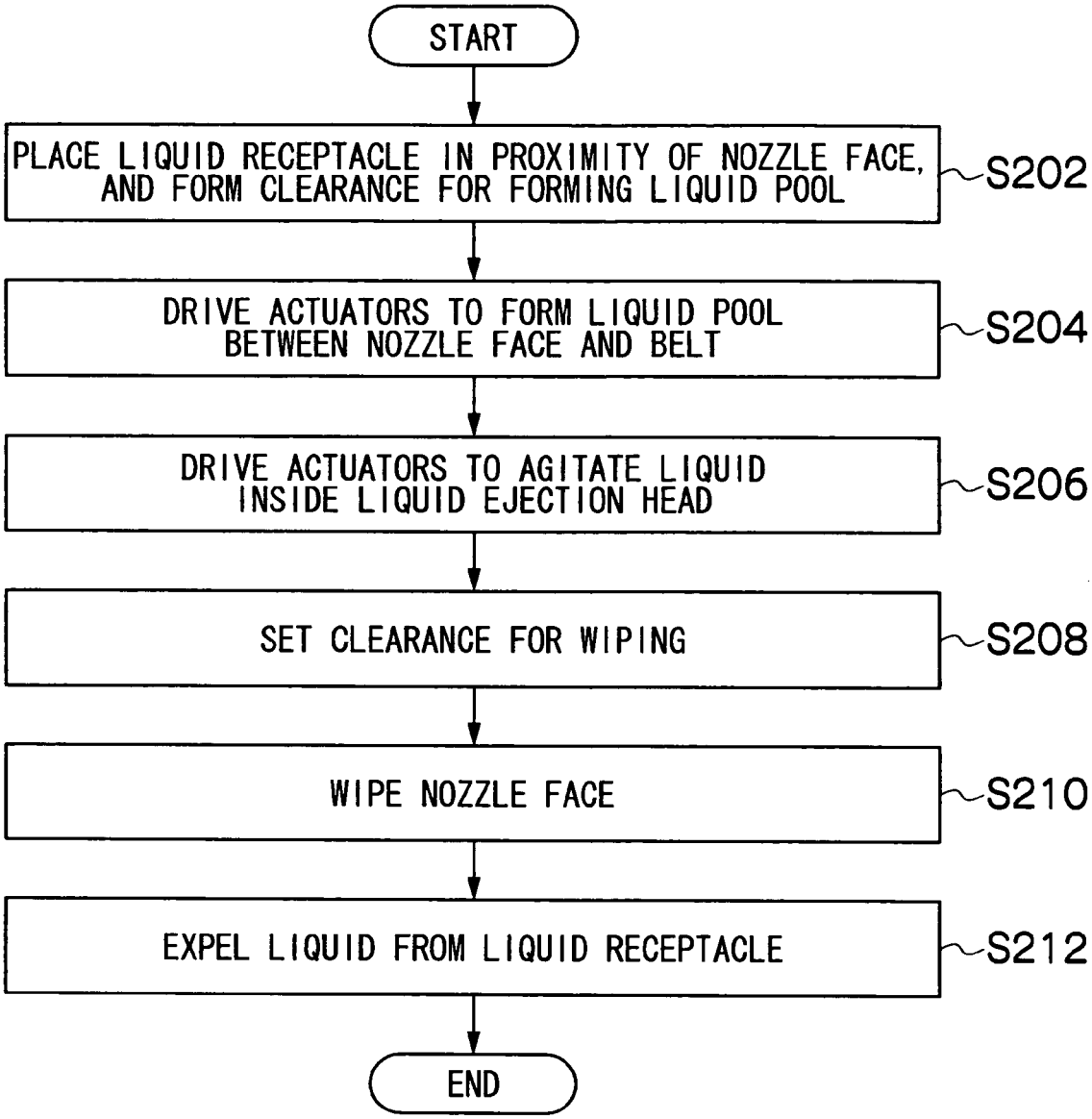
FIG. 19 is an approximate flowchart showing an embodiment of a sequence of a liquid agitation process performed by forming a liquid pool.

The liquid agitation process shown in FIG. 19 is started in a state where the free surface of the liquid in the nozzles 51 of the liquid ejection head 50 is positioned in the vicinity of the nozzle face 510, as shown in FIG. 17A.

As shown in FIG. 19, firstly, the liquid receptacle 70 is placed in the proximity of the nozzle face 510 of the liquid ejection head 50 (step S202).

More specifically, the liquid receptacle 70, which has been positioned in a prescribed standby position, is moved in the sub-scanning direction to a maintenance position directly below the liquid ejection head 50, and furthermore, the belt 80 of the liquid receptacle 70 is rotated and the liquid-philic part 83 of the belt 80 in the liquid receptacle 70 is made opposite to the nozzle face 510 of the liquid ejection head 50. The clearance between the liquid-philic part 83 of the belt 80 of the liquid receptacle 70 and the nozzle face 510 is set to a distance where the liquid pool can be maintained by means of the interfacial tension of the liquid.

Thereupon, a drive signal for liquid pool creation is applied to the actuators 58 of the liquid ejection head 50 to drive the actuators 58, whereby the liquid is ejected from the nozzles 51 of the liquid ejection head 50 toward the belt 80 of the liquid receptacle 70, thus forming the liquid pool 351 between the nozzle face 510 of the liquid ejection head 50 and the liquid-philic part 83 of the belt 80, as shown in FIG. 13 (step S204).

Thereupon, a drive signal for liquid agitation is applied to the actuators 58 of the liquid ejection head 50 to drive the actuators 58, and the liquid inside the liquid ejection head 50 is agitated (step S206). Here, the drive condition of the actuators 58 is set to either the drive condition 1 or the drive condition 2 described above.

Figure 20:
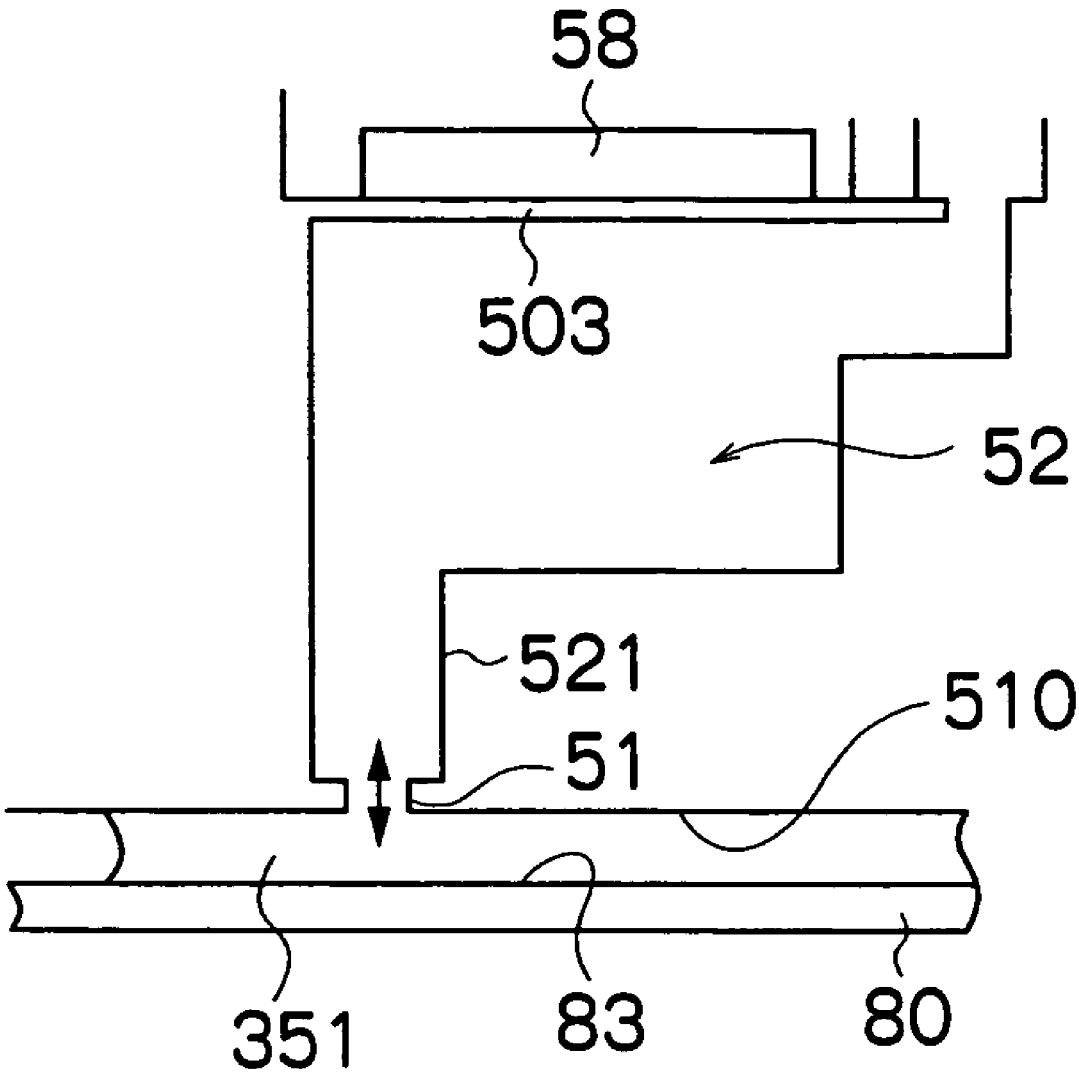
FIG. 20 is a schematic diagram showing a state of liquid agitation using a liquid pool.

By driving the actuators 58, the liquid inside the pressure chambers 52 is vibrated and agitated through the diaphragm 503, and the liquid in the region over the ejection flow channels 521 and the liquid-philic part 83 of the belt 80 is also vibrated and agitated, as shown in FIG. 20. Moreover, by means of the recess section 545 formed in the actuator protection plates 504 and 505 shown in FIG. 2, the heat generated by the driving of the actuators 58 is transmitted to the liquid inside the common liquid chamber 55 through the diaphragm 503, thereby agitating the liquid inside the common liquid chamber 55 as well.

Then, after applying the drive signal for the liquid agitation to the actuators 58 for a prescribed period of time, the belt 80 in the liquid receptacle 70 is rotated, and the opening section 81 of the belt 80 in the liquid receptacle 70 is made opposite to the nozzle face 510 of the liquid ejection head 50. Moreover, the clearance between the nozzle face 510 and the liquid-philic part 83 of the belt 80 in the liquid receptacle 70 is set to a distance where the wipers 75 arranged on the liquid receptacle 70 come in contact with the nozzle face 510 when sliding the wipers 75 over the nozzle face 510 of the liquid ejection head 50 (step S208).

Next, an operation (wiping operation) for sweeping the wipers 75 over the nozzle face 510 of the liquid ejection head 50 is carried out (step S210).

Thereupon, the liquid inside the liquid receptacle 70 is suctioned with the suction pump 67, and expelled to the waste liquid tank 68 (step S212).

The wiping operation (step S210) and the expulsion of the liquid (step S212) may be performed in reverse sequence or simultaneously.

By carrying out the liquid agitation in the state where the liquid pool has been formed in this way, it is possible to efficiently agitate the liquid containing aggregated and sedimented micro-particles in the vicinity of the nozzles 51. It is also possible to remove semi-solid material of increased viscosity, solid material, dust, and the like, that have adhered to the nozzles 51. Furthermore, no excessive load is applied to the actuators 58.

Third liquid agitation mode: Mode returning all liquid into main tank

In this mode, the liquid inside the liquid ejection head 50, the sub-tank 61,-and all of the flow channels from the main tank 60 to the liquid ejection head 50 is completely returned into the main tank 60, and the returned liquid is then agitated inside the main tank 60.

One embodiment of the liquid agitation process that is carried out by returning all of the liquid inside the image forming apparatus 110 into the main tank 60 in this way is described below.

Firstly, the liquid agitation process that is performed when the power supply of the image forming apparatus 110 is turned off is described.

Figure 21:
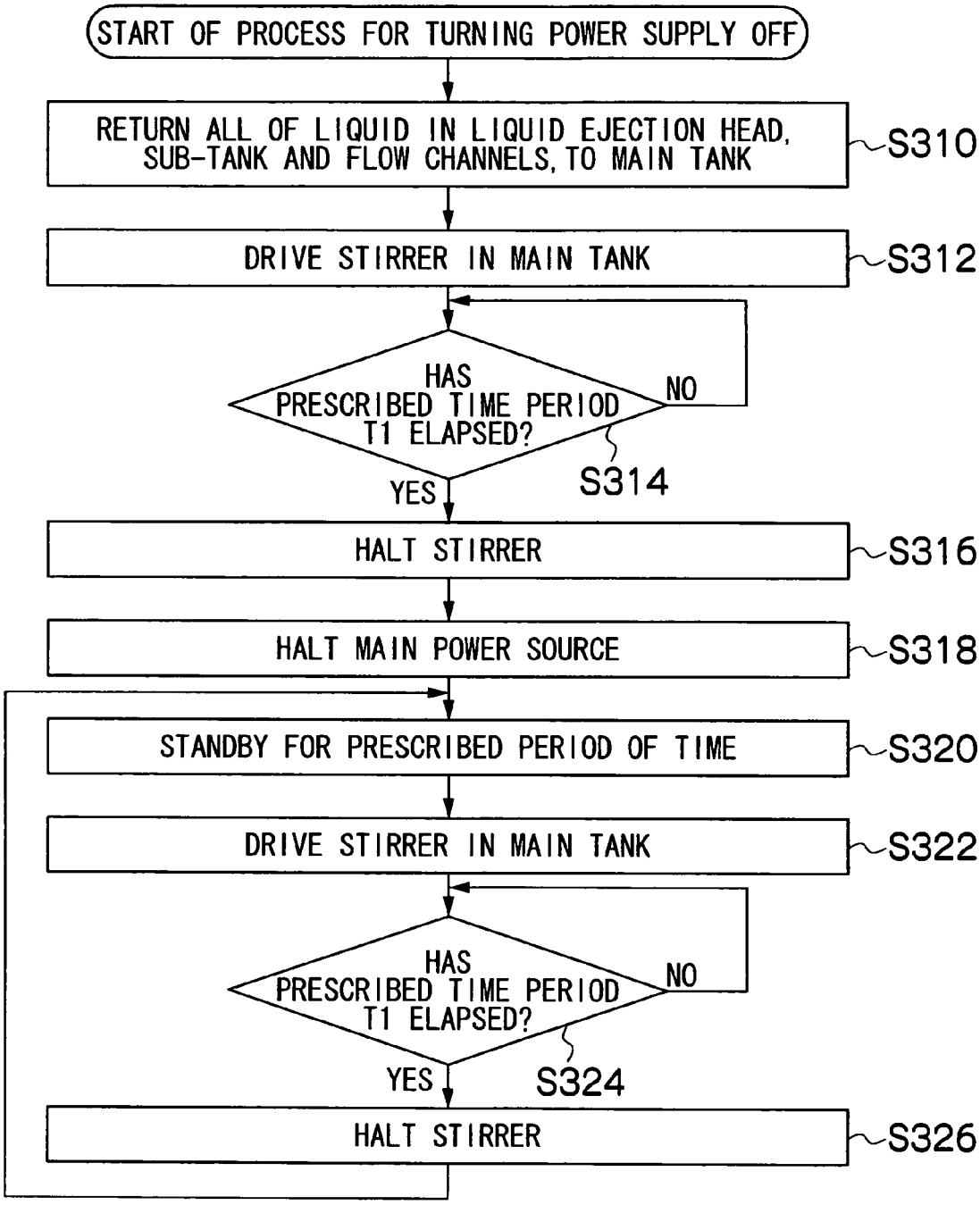
FIG. 21 is a flowchart showing an embodiment of a processing sequence when the power supply is turned off, in a liquid agitation process performed by returning all of the liquid inside the apparatus.

The liquid agitation process shown in FIG. 21 starts when the free surface of the liquid inside the nozzles 51 of the liquid ejection head 50 is positioned in the vicinity of the nozzle face 510 and the power supply of the image forming apparatus 110 is turned off.

In FIG. 21, the liquid inside the liquid ejection head 50, the sub-tank 61, and the flow channels between the main tank 60 and the liquid ejection head 50 is all returned into the main tank 60 (step S310).

Here, in the liquid flow system shown in FIG. 5, the first electromagnetic valve 41 and the second electromagnetic valve 42 are opened, and the liquid supply pump 62 is driven in reverse for a prescribed period of time. On the other hand, in the liquid flow system shown in FIG. 6, the first electromagnetic valve 41, the second electromagnetic valve 42 and the third electromagnetic valve 43 are opened, the liquid supply pump 62 is then driven in reverse for a prescribed period of time, and the fourth electromagnetic valve 44 is opened and the pump 64 is then driven in reverse for a prescribed period of time.

After the liquid is all returned into the main tank 60, the stirrer 32 in the main tank 60 is rotated by driving the stirrer drive unit 224, thereby starting agitation of the liquid inside the main tank 60 (step S312). Then, it is judged whether or not a prescribed time period Ti has elapsed (step S314), and when the prescribed time period T1 has elapsed, then the stirrer 32 is halted (step S316).

Thereupon, the supply of electrical power from the main power source 240 of the image forming apparatus 110 to the respective units is halted (step S318). In other words, the image forming apparatus 110 is turned to the power-off state.

While the image forming apparatus 110 is in the power-off state, in other words, while the power supply from the main power source 240 is halted, then after waiting for a prescribed period of time with the stirrer 32 in the halted state (step S320), the stirrer drive unit 224 is driven and the stirrer 32 in the main tank 60 is rotated by supplying power from the standby power source 242 (step S322). It is then judged whether or not the prescribed time period T1 has elapsed (step S324), and when the prescribed time period Ti has elapsed, then the stirrer 32 is halted (step S356).

Thereafter, the liquid inside the main tank 60 is agitated by supplying power from the standby power source 242 at prescribed time intervals. Accordingly, it is possible to prevent aggregation and sedimentation of the micro-particles in the liquid, even if the image forming apparatus 110 remains in the power-off state for a long period of time.

Rather than setting the direction of rotation of the stirrer 32 to one direction only, it is preferable to perform forward rotation and reverse rotation, in alternating fashion. It is also possible to repeat the sequence of: forward rotation for the prescribed period of time→leave in idle state for the prescribed period of time→reverse rotation for the prescribed period of time→leave for the prescribed period of time→forward rotation for the prescribed period of time→, and so on.

Furthermore, it is preferable that the rotational speed is increased continuously (or in steps) from a low speed to a high speed, and then decreased continuously (or in steps) from the high speed to the low speed, the stirrer is halted, and the direction of rotation is then reversed. Thereby, it is possible to further increase the agitation effect.

In order to avoid blockages due to aggregation and/or sedimentation of the micro-particles in the liquid, at all places in the image forming apparatus, it is important to adopt the mode that agitates all of the liquid inside the liquid ejection head 50, the main tank 60, the sub-tank 61 and the flow channels. Here, there is a mode that simultaneously agitates the liquid at all places in the liquid ejection head 50, the main tank 60, the sub-tank 61 and the flow channels; however, if the liquid is agitated at all places in the image forming apparatus 110, then the power consumption inevitably increases. Therefore, if it is necessary to agitate the whole liquid, then a preferable mode is one in which the liquid at all places is first returned into the main tank 60 and the whole liquid is then agitated inside the main tank 60.

Next, the liquid agitation process when the power of the image forming apparatus 110 is turned on is described below with reference to the flowchart in FIG. 22.

Figure 22:
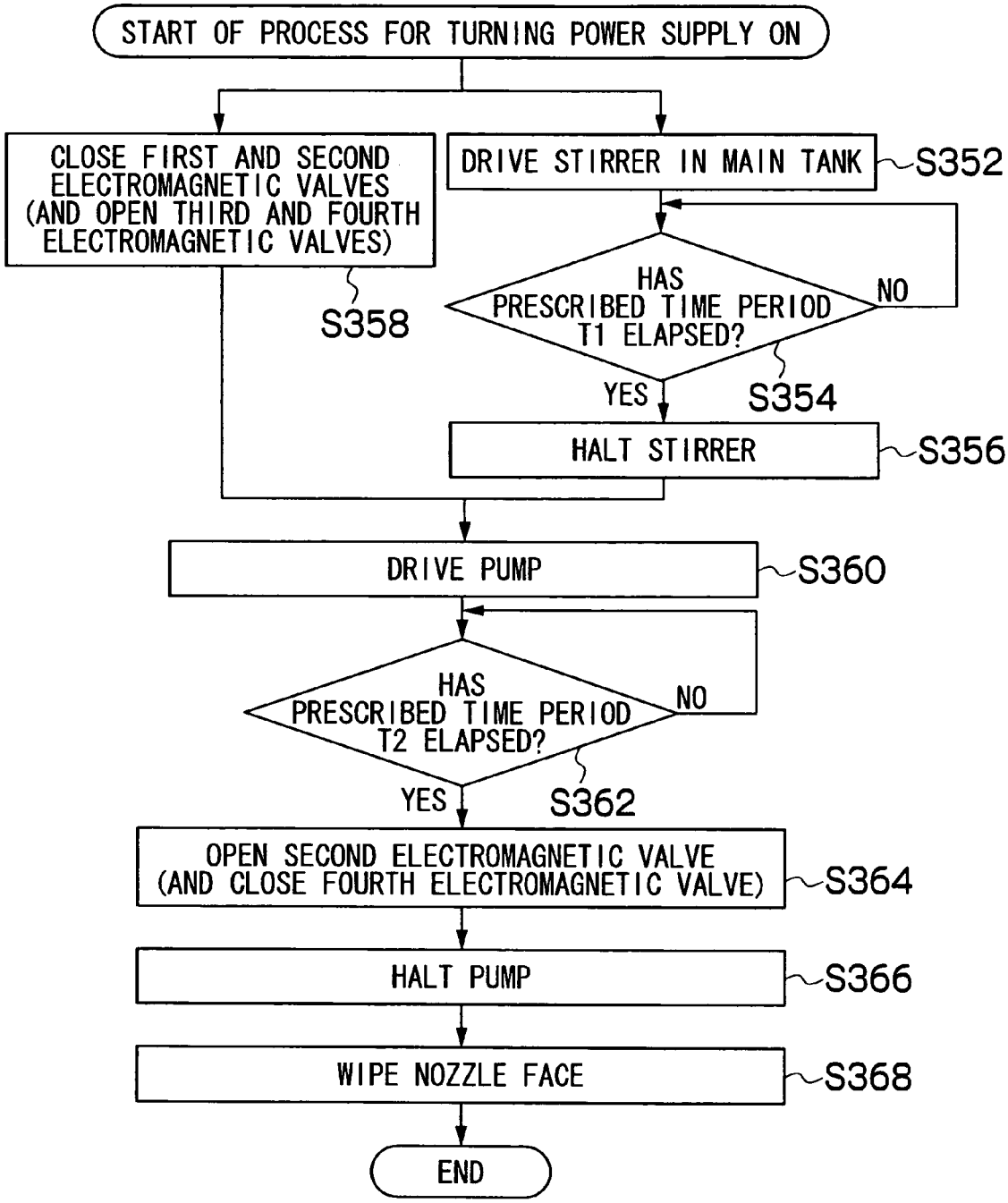
FIG. 22 is a flowchart showing an embodiment of a processing sequence when the power supply is turned on, in a liquid agitation process performed by returning all of the liquid inside the apparatus.

In FIG. 22, in a state where the liquid has all been returned to the main tank 60, the stirrer 32 in the main tank 60 is rotated by driving the stirrer drive unit 224, thereby starting agitation of the liquid in the main tank 60 (step S352). It is then judged whether or not the prescribed time period T1 has elapsed (step S354), and when the prescribed time period T1 has elapsed, then the stirrer 32 is halted (step S356).

Moreover, in the liquid flow system shown in FIG. 5, the first electromagnetic valve 41 and the second electromagnetic valve 42 are closed (step S358), the liquid supply pump 62 is driven (step S360), and it is then judged whether or not the prescribed time period T2 has elapsed (step S362). On the other hand, in the liquid flow system shown in FIG. 6, the first electromagnetic valve 41 and the second electromagnetic valve 42 are closed and the third electromagnetic valve 43 and the fourth electromagnetic valve 44 are opened (step S358), the liquid supply pump 62 is driven (step S360), and then it is judged whether or not the prescribed time period T2 has elapsed (step S362).

When the prescribed time period T2 has elapsed, then in the liquid flow system shown in FIG. 5, the second electromagnetic valve 42 is opened (step S364), and the liquid supply pump 62 is halted (step S366). In the liquid flow system shown in FIG. 6, the second electromagnetic valve 42 is opened, the fourth electromagnetic valve 44 is closed (step S364), and the liquid supply pump 62 is halted (step S366).

Thereupon, the liquid receptacle 70 is made opposite to the liquid ejection head 50, and the nozzle face 510 of the liquid ejection head 50 is wiped (step S368).

It is not necessary to carry out all of the first, second and third liquid agitation modes described above. Moreover, it is also possible to perform the liquid agitation by means of a mode other than the first, second and third liquid agitation modes.

Preferably, the liquid agitation process is selected in accordance with the circumstances of the image forming apparatus 110.

For example, it is also possible that, while the image forming apparatus 110 is in the power-off state, in other words, while the power supply from the main power source 240 is halted, only the third liquid agitation mode is carried out, and on the other hand, while the image forming apparatus 110 is in the power-on state, in other words, while there is the power supply from the main power source 240; only the liquid inside the main tank 60 is agitated by means of the stirrer 32 at prescribed time intervals, without returning the whole liquid into the main tank 60. In the power-on state, since liquid ejection and liquid supply are performed, then the liquid in the image forming apparatus 110 is maintained in a substantially uniform state. Moreover, in this case, only the stirrer 32 in the main tank 60 is required as the liquid agitation device.

Moreover, it is also possible that, while the image forming apparatus 110 is in the power-off state, only the third liquid agitation mode is carried out, and on the other hand, while the image forming apparatus 110 is in the power-on state, the first liquid agitation mode (i.e., the mode where the liquid inside the liquid ejection head 50 is agitated after the free surface of the liquid in the nozzles 51 is withdrawn) is carried out and the liquid inside the main tank 60 is agitated by means of the stirrer 32 at prescribed time intervals, without returning the whole liquid into the main tank 60. In the power-on state, since liquid ejection and liquid supply are performed, then the liquid in the image forming apparatus 110 is maintained in a substantially uniform state. Moreover, in this case, the actuators 58 in the liquid ejection head 50 for ejecting the liquid also serve as the liquid agitation devices, and hence it is possible to restrict increase in manufacturing costs.

Further, it is also possible that, while the image forming apparatus 110 is in the power-off state, only the third liquid agitation mode is carried out, and on the other hand, while the image forming apparatus 110 is in the power-on state, the second liquid agitation mode (i.e., the mode where the liquid inside the liquid ejection head 50 is agitated after forming the liquid pool) is carried out and the liquid inside the main tank 60 is agitated by means of the stirrer 32 at prescribed time intervals, without returning the whole liquid into the main tank 60. In the power-on state, since liquid ejection and liquid supply are performed, then the liquid in the image forming apparatus 110 is maintained in a substantially uniform state. Moreover, in this case, the actuators 58 in the liquid ejection head 50 for ejecting liquid also serve as the liquid agitation devices, and the liquid receptacle 70 is used for capping, dummy ejection, suctioning and wiping, then it is possible to restrict increase in manufacturing costs.

Furthermore, it is also possible that, in the power-off state or when the power is turned on, the third liquid agitation mode is adopted, in other words, substantially all of the liquid inside the image forming apparatus 110 including the liquid inside the liquid ejection head 50 is returned into the main tank 60 and the liquid is then agitated inside the main tank 60. On the other hand, when the power is turned on, if it is judged that the image forming apparatus 110 has been in the standby state for a prescribed time period or above (a prolonged standby state), then the second liquid agitation mode is adopted, in other words, the liquid inside the liquid ejection head 50 is agitated by forming the liquid pool using the liquid receptacle 70, and the liquid inside the main tank 60 is agitated by using the stirrer 32. If it is judged that the image forming apparatus 110 has been in the standby state for a period less than the prescribed time period (a short standby state) when the power is turned on, then the first liquid agitation mode is adopted, in other words, the free surface of the liquid in the nozzles 51 are withdrawn and the liquid only inside the liquid ejection head 50 is then agitated. Alternatively, in the case of the short standby state, it is also possible to carry out slight vibration of the free surface of the liquid in the nozzles 51 by driving the actuators 58 to an extent that does not cause the liquid to be ejected, while the free surface of the liquid in the nozzles 51 is positioned in the vicinity of the nozzle face 510, without withdrawing the free surface of the liquid, forming a liquid pool, and returning the liquid into the main tank 60. In this slight vibration of the free surface of the liquid, it is desirable to sweep the frequency of the drive signal applied to the actuators 58. In the image forming apparatus 110 shown in FIG. 14, the liquid agitation process is selected in accordance with the circumstances of the image forming apparatus 110 by the system controller 212.

The common liquid chamber 55 is situated on the opposite side of the actuators 58 from the pressure chambers 52 in the above-described embodiments as shown in FIGS. 1 and 2, but the present invention may also be applied to a composition where the common liquid chamber is situated on the same side of the actuators as the pressure chambers, as long as the direction of liquid ejection is a downward direction.

The liquid ejected from the liquid ejection head 50 is ink in the above-described embodiments, but the present invention may also be applied to a conductive liquid ejected toward a substrate when forming conductive wires on the substrate, or a liquid ejected toward an optical material during manufacture of a color filter, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head which has an ejection face formed with an ejection port ejecting liquid, a pressure chamber being in connection with the ejection port, and an energy application element applying energy to the liquid in the pressure chamber to be ejected from the ejection port, the energy application element being arranged on a wall of the pressure chamber;

a liquid receiving device which has a liquid reception face being opposite to the ejection port and receiving the liquid ejected from the ejection port, the liquid received by the liquid reception face forming a liquid pool being in contact with the liquid reception face and the ejection face; and a driving device which applies a drive signal to the energy application element in a state where the liquid pool has been formed and where the liquid contiguous from the pressure chamber though the ejection port to the liquid pool, so as to agitate the liquid at least in a vicinity of the ejection port by moving the liquid to-and-from between the pressure chamber and the liquid pool through the ejection port.

2. The liquid ejection apparatus as defined in claim 1, wherein the driving device causes a frequency of the drive signal to continuously change from a first frequency to a second frequency different from the first frequency.

3. The liquid ejection apparatus as defined in claim 1, wherein the liquid receiving device includes a belt which has an opening section and the liquid reception face, the belt being switchable by rotation between a state where the opening section is opposite to the ejection port and a state where the liquid reception face is opposite to the ejection port.

4. The liquid ejection apparatus as defined in claim 1, wherein the liquid receiving device includes a wiper which slides on the ejection face of the liquid ejection head.

5. The liquid ejection apparatus as defined in claim 1, wherein the liquid receiving device includes a sealing member which hermetically seals the ejection face of the liquid ejection head.

6. The liquid ejection apparatus as defined in claim 1, further comprising:

a suction device which is connected to the liquid receiving device, wherein the suction device suctions the liquid from the ejection port of the liquid ejection head in a state where the liquid receiving device is in hermetic contact with the liquid ejection head.

7. The liquid ejection apparatus as defined in claim 1, wherein:

the liquid receiving device has a liquid-philic surface having liquid-philic properties and a liquid-phobic surface having liquid-phobic properties; and the liquid pool is formed between the liquid-philic surface serving as the liquid reception face and the ejection port of the liquid ejection head.

8. The liquid ejection apparatus as defined in claim 1, wherein:

a coloring material is dispersed in the liquid; and the liquid ejected from the ejection port is deposited on a prescribed recording medium to form an image on the recording medium, whereby the liquid ejection apparatus serves as an image forming apparatus.

9. A liquid agitation method of agitating liquid in a liquid ejection head which has an ejection face formed with an ejection port ejecting the liquid, a pressure chamber being in connection with the ejection port, and an energy application element applying energy to the liquid in the pressure chamber to be ejected from the ejection port, the energy application element being arranged on a wall of the pressure chamber, the method comprising the steps of:

setting a liquid receiving device to a position opposite to the ejection port of the liquid ejection head, the liquid receiving device having a liquid reception face being opposite to the ejection port and receiving the liquid ejected from the ejection port;

forming a liquid pool being in contact with the ejection face and the liquid reception face in a state where the ejection port and the liquid receiving device are opposite to each other; and applying a drive signal to the energy application element in a state where the liquid pool has been formed and where the liquid contiguous from the pressure chamber through the ejection port to the liquid pool, so as to agitate the liquid at least in a vicinity of the ejection port by moving the liquid to-and-fro between the pressure chamber and the liquid pool through the ejection port.

* * * * *